US005762530A

United States Patent [19]

Zheng

[11] Patent Number: 5,762,530

[45] Date of Patent: Jun. 9, 1998

[54] CONSTRUCTIONAL TOY PIECES

[75] Inventor: Yu Zheng, Covina, Calif.

[73] Assignee: Patent Category Corp., Monrovia, Calif.

[21] Appl. No.: 665,084

[22] Filed: Jun. 14, 1996

Related U.S. Application Data

[63] Continuation-in-part of Ser. No. 584,519, Jan. 11, 1996, Pat. No. 5,605,486.

[51] Int. Cl.[6] ..... A63H 33/08

[52] U.S. Cl. ..... 446/114; 273/160

[58] Field of Search ..... 446/114; 273/160

[56] References Cited

U.S. PATENT DOCUMENTS

| | | | |
|---|---|---|---|
| D. 4,058 | 5/1870 | Ellis . | |
| D. 245,435 | 8/1977 | Gnehm . | |
| D. 247,132 | 1/1978 | Gnehm . | |
| 1,163,851 | 12/1915 | Pringle . | |
| 1,453,241 | 4/1923 | Duffield | 446/114 |
| 1,562,006 | 2/1925 | Sichterman . | |
| 3,023,890 | 3/1962 | Scholten . | |
| 4,198,053 | 4/1980 | Rao | 273/160 |
| 5,215,490 | 6/1993 | Szoradi | 446/115 |
| 5,281,181 | 1/1994 | McCollum | 446/106 |
| 5,605,486 | 2/1997 | Zheng | 446/114 |

*Primary Examiner*—William H. Grieb
*Attorney, Agent, or Firm*—Raymond Sun

[57] ABSTRACT

Puzzle pieces and connectors are provided to assemble a large variety of two and three-dimensional objects, including objects with moving parts. Puzzle pieces utilize joints and apertures to interconnect the pieces. Supporting protrusions are provided in some embodiments to reinforce and strengthen the legs of joints. Other elements provided with these connecting joints and apertures, such protrusions, ridges, securing apertures, enlarged ends, gripping legs, and grooves, assist in providing a more secure interconnection between pieces. Connectors may be provided to build pivotable connections.

14 Claims, 18 Drawing Sheets

147
146
144
138
136
140
142
120

T2
152
118
148
128
126
132
130
W2
134
122
124

146
138
120
134
118

154
156
158
150

340
342
318a
320a
332a 340
1
316a
332a
330a
310a
308a
314a 340
326a
342

320a
326a
318a
342

313
2

484
458
472
476

456
480
474
470

454
464
462

468
452

478
466
482
450

CONSTRUCTIONAL TOY PIECES

RELATED APPLICATION

This application is a continuation-in-part of application Ser. No. 08/584,519, filed Jan. 11, 1996, now U.S. Pat. No. 5,605,486, entitled "Three Dimensional Model Structures", which is incorporated by this reference as though set forth fully herein.

BACKGROUND OF THE INVENTION

1. Field of the Invention

The present invention relates to three-dimensional objects, and in particular, to puzzle or constructional toy pieces that can be used to assemble three-dimensional objects.

2. Description of the Prior Art

For purposes of the present application, the terms "puzzle piece" and "constructional toy piece" shall be used interchangeably, and are intended to have the same meaning.

Puzzles and constructional toys are popular among both children and adults. A two-dimensional puzzle usually involves the selection and sequential assembly of a plurality of puzzle pieces having varying contour to create an original image about a flat sheet board. More complex puzzles include three-dimensional self-standing structures that are assembled by interlocking a variety of puzzle pieces.

Examples of prior three-dimensional structures that are assembled from puzzle pieces are illustrated in U.S. Pat. No. 2,278,327 (Magnus et al.), U.S. Pat. No. 3,701,214 (Sakamoto) and U.S. Pat. No. 5,251,900 (Gallant), in which the puzzle pieces are interconnected by means of dovetail joints. However, these prior puzzle pieces suffer from the drawback that the puzzle pieces do not allow the user to assemble a wide variety of three-dimensional model objects.

My co-pending application Ser. No. 08/584,519, filed Jan. 11, 1996, and entitled "Three-Dimensional Model Structures", is directed to a variety of puzzle pieces that can be interconnected with other puzzle pieces to form model structures or other objects. Some of the pieces have at least one joint having a substantially U-shaped mortise defined by a first leg and a second leg. The pieces are interconnected by inserting the U-shaped mortise of a joint to the U-shaped mortise of another joint to be interconnected therewith such that the two joints, and the interconnected pieces, are transverse to each other. However, the puzzle pieces of the invention of my co-pending application Ser. No. 08/584,519 do not have means for holding or otherwise better securing the interconnection between the joints. This feature can be especially advantageous when the pieces are used to construct permanent objects, or objects that the user does not intend to disassemble.

Thus, there remains a need for a plurality of puzzle pieces that can be assembled into a wide variety of three-dimensional objects. There is also a need for puzzle pieces having joints that are easy to connect during assembly of the object, and which provide a secure interconnection of the puzzle pieces.

SUMMARY OF THE DISCLOSURE

In order to accomplish the objects of the present invention, there is provided an object assembled by interconnecting a plurality of puzzle pieces.

In a first preferred embodiment of the present invention, first and second pieces are connected by transversely inserting the joint of one piece into a similar joint of another piece. One or more bumps are provided in the joints to define spaces in the joints for receiving the bumps from the other connecting joint.

In second and third preferred embodiments of the present invention, first and second pieces are connected by inserting the leg of a joint in a first piece through an aperture in a second piece. A ridge or other stop member may be positioned in the aperture to position the joint of the first piece securely inside the aperture.

In a fourth preferred embodiment of the present invention, first and second pieces are connected by transversely inserting the joint of one piece into a similar joint of another piece. A first piece has an aperture that is adapted to receive and engage an enlarged end at the joint of the second piece.

In a fifth preferred embodiment of the present invention, first and second pieces are connected by transversely inserting the joint of one piece into a similar joint of another piece. Each piece has a groove spaced apart from the joint on an outer side edge opposite from the joint, with the groove adapted to receive and engage an enlarged end at the joint of the other piece.

In sixth through eleventh preferred embodiments of the present invention, first and second pieces are connected by inserting the leg of an extension of a first piece through a first aperture in a second piece. The leg extends parallel to the outer side edge of the first piece and defines a gap therebetween for gripping or receiving the body of the second piece.

In the seventh preferred embodiment, the second piece is provided with a second aperture spaced apart from the first aperture for receiving and engaging an enlarged end of the leg of the first piece.

In the eighth and ninth preferred embodiments, the extension has a second leg extending in a direction opposite from that of the first leg and parallel to the outer side edge of the first piece to define another gap therebetween for gripping or receiving the body of the second piece.

In the ninth preferred embodiment, the first piece may be rotated within the first aperture so that the gaps defined by the first and second legs receive and grip the body of the second piece adjacent the first aperture.

In the tenth preferred embodiment, the first aperture has first and second vertical edges, with the first ends of the first and second longitudinal edges connected to the first vertical edge, the first ends of upper and lower edges connected to the second vertical edge, and second ends of the upper and lower edges coupled to second ends of the first and second longitudinal edges. The distance of the first aperture between the upper and lower edges is greater than the distance of the aperture between the first and second longitudinal edges.

In the eleventh preferred embodiment, the extension comprises two stems and two legs, each leg extending along the outer side edge in opposing directions and defining a gap between the leg and the outer side edge. A slit or gap is provided between the two stems of the extension to allow the stems to be flexed to be fitted inside an aperture that is slightly smaller in dimension than the length of the combined legs and slit.

In a twelfth preferred embodiment of the present invention, first and second pieces are connected by force-fitting an extension of one piece through or into an aperture of the other piece. The aperture is dimensioned to be slightly smaller than the extension.

Connectors according to the present invention provide pivotable connections with the pieces. The connectors have at least two spaced apart channels for rotatably receiving enlarged ends of portions of joints of pieces that are to be connected to the connectors.

In a further preferred embodiment of the present invention, an elongated connector may be provided. A first piece may be inserted through an aperture provided in a second piece, and the elongated connector may be inserted through an aperture of the first piece adjacent the aperture of the second piece to secure the two pieces at the aperture of the second piece.

Thus, the puzzle pieces and connectors according to the present invention can be used to assemble a large variety of two and three-dimensional objects, including objects with moving parts. Supporting protrusions are provided in some embodiments to reinforce and strengthen the legs of joints. Connectors are provided to build pivotable connections. Other elements, including but not limited to protrusions, ridges, securing apertures, enlarged ends, gripping legs, and grooves, assist in providing a more secure interconnection between pieces. These connections are easy to achieve, and are secure.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figures 14A, 14B, 14C:
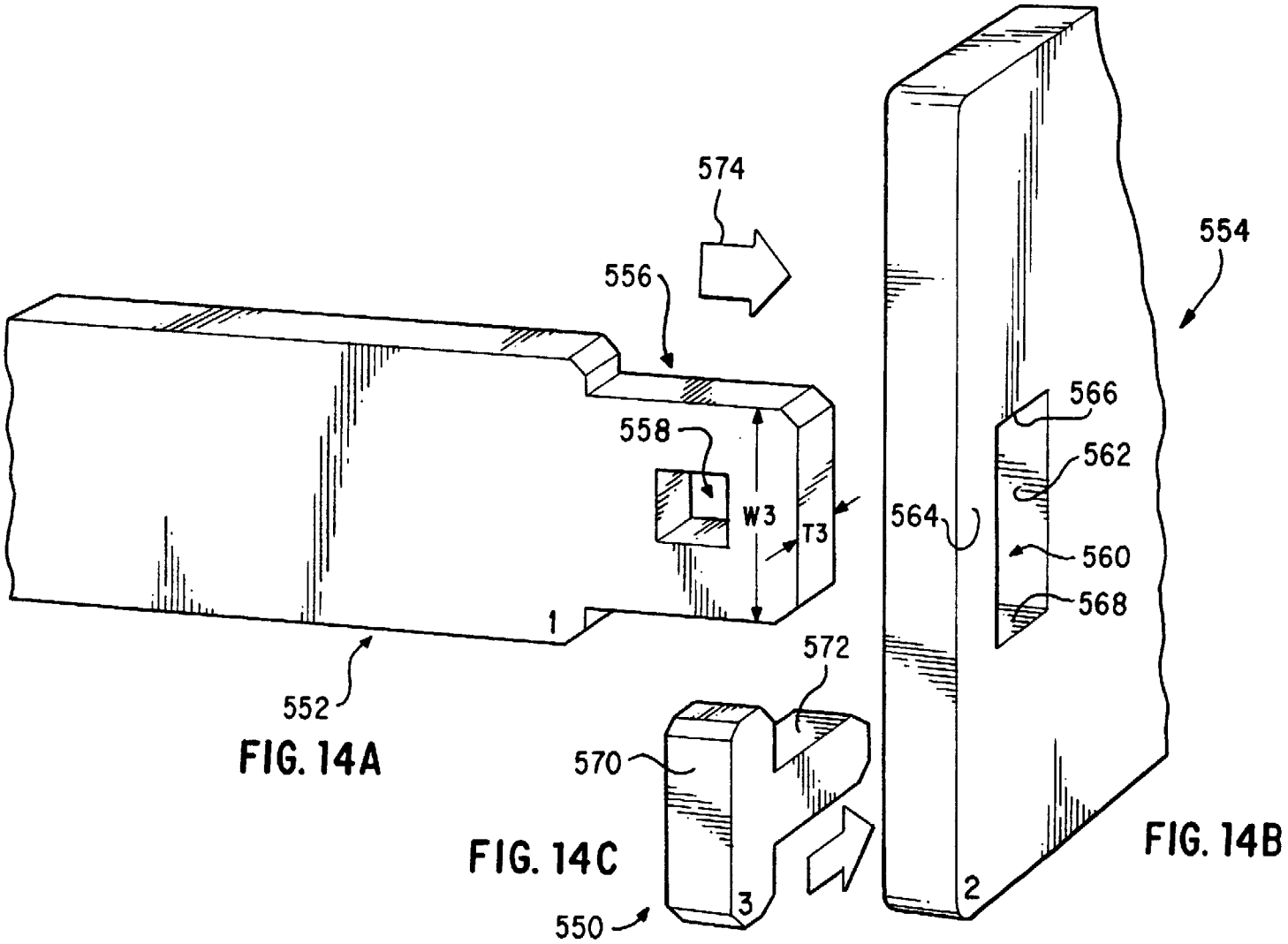
FIGS. 14A–14C illustrate perspective views of two puzzle pieces interconnected by a connector according to another preferred embodiment of the present invention.
Figure 15:
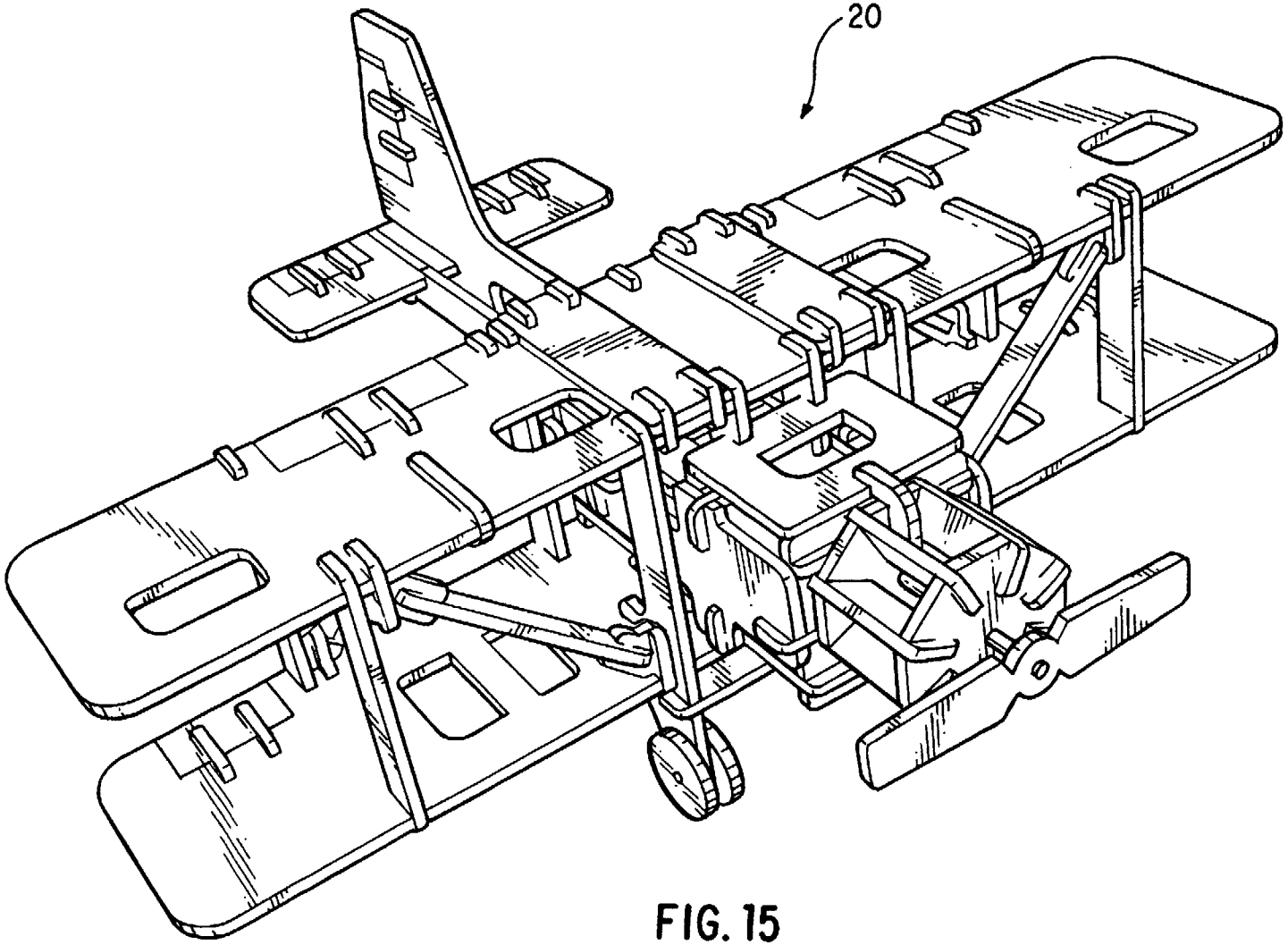
FIG. 15 is a perspective view of a three-dimensional model structure, a plane, assembled with the interconnecting puzzle pieces according to the present invention.

A three-dimensional self-standing model structure 20 is shown in FIG. 15. Model structure 20, an airplane, is assembled by connecting a plurality of puzzle pieces or constructional toy pieces which will be described in connection with FIGS. 1–14. The puzzle pieces may have images provided on their surfaces to decorate the model structure 20, as described in greater detail hereinbelow. The puzzle pieces according to the present invention can be assembled to create a variety of model structures 20, including but not limited to planes, ships, trains, buildings, furniture, automobiles, animals, plants, and abstract sculptures, as well as useful utility household items, gardening items, wearable accessories (such as belts and jewelry), and other items.

Figure 1B:
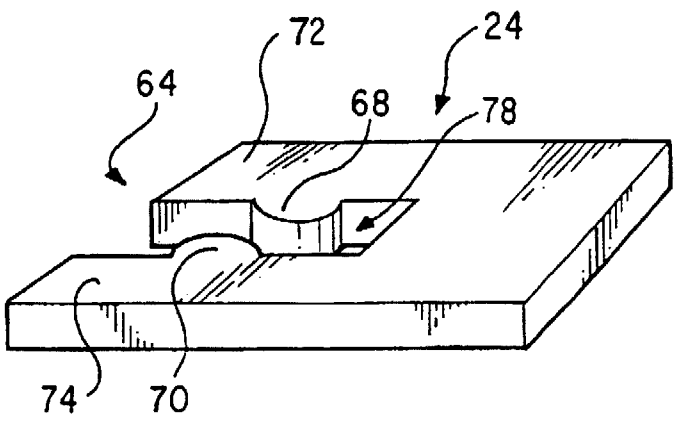
FIGS. 1A and 1B illustrate perspective views of portions of two interconnecting puzzle pieces according to a first embodiment of the present invention.
Figure 1A:
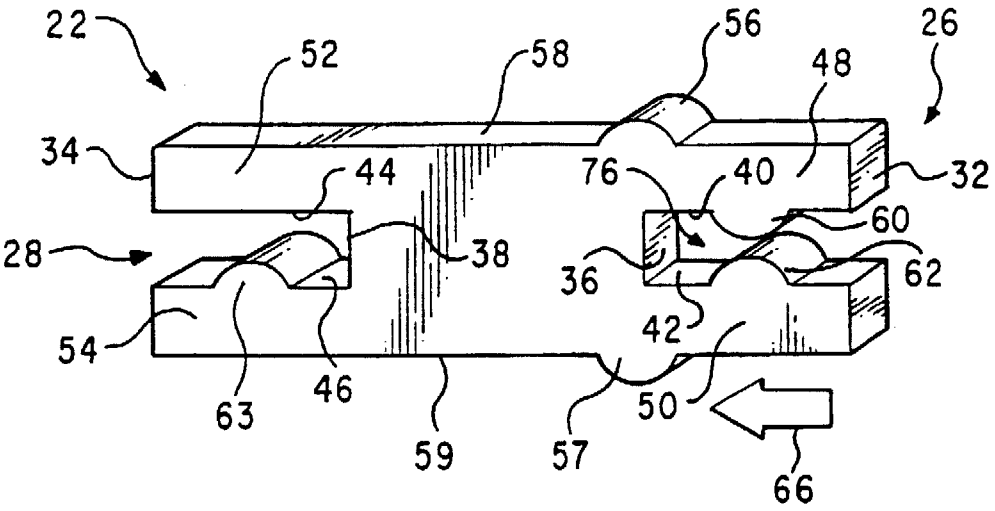

A first preferred embodiment of a pair of interconnecting puzzle pieces 22 and 24 is shown in FIGS. 1A and 1B. The first piece 22 has two interlocking joints 26 and 28 provided on opposite side edges 32 and 34, respectively. Each interlocking joint 26 and 28 has a substantially U-shaped mortise part that is cut out of an outer side edge 32 and 34, respectively, of piece 22. Each substantially U-shaped mortise part of joints 26 and 28 is defined by a bottom edge 36 and 38, respectively, connected by two inner side edges 40, 42 and 44, 46, respectively. Thus, each joint 26 and 28 is defined by a U-shaped mortise opening having two tenons or legs 48, 50 and 52, 54, respectively, on either side of the mortise opening. The legs 48, 50 and 52, 54 are each defined by at least an inner side edge and an outer side edge. For example, leg 48 has an inner side edge 40 and an outer side edge 32.

In addition, supporting protrusions or bumps may optionally be provided along side edges of the piece 22 to provide additional strength to the legs to prevent the legs from snapping or breaking after extended use. For example, curved or substantially semi-circular protrusions 56 and 57 are provided at a location along outer side edges 58 and 59, respectively, approximately opposite the bottom edge 36 of joint 26. If protrusions 56 and 57 were not provided, the legs 48 and 50, respectively, would be weakest at the location directly opposite the bottom edge 36 at about the location of the protrusion 56, 57 because those are the locations where a long strip of thin mass (i.e., the leg 48 or 50) becomes a wider mass (i.e., the body of the piece 22), and can be easily snapped or broken off at about that location if excessive force is applied. Therefore, the protrusions 56 and 57 increase the mass at the weakest location of the legs 48 and 50, respectively, and provide reinforcement and support to that location, making it more difficult to snap or break even after extended or careless use.

The size and shape of the supporting protrusions according to the present invention are not critical, although the protrusions should be large enough to provide sufficient support, and should have an aesthetically pleasing shape that also does not obstruct the interconnection of pieces. For example, the protrusions can have a bulbous, semi-circular, triangular, square, polygonal, rectangular or any other shape. Also, different protrusions can be provided with different shapes and sizes, on different pieces or even on the same piece.

Piece 22 further includes locking bumps or protrusions 60 and 62 provided along inner side edges 40 and 42, respectively, of joint 26. These bumps 60 and 62 operate to lock or secure the interconnection of joint 26 with another joint of another puzzle piece. Joint 28 is shown as having only one bump 63 provided along inner side edge 46. Thus, locking bumps can be provided along one or both inner side edges of each joint.

The puzzle piece 24 of FIG. 1B is also provided with joints which may be identical to joints 26 or 28 of puzzle piece 22. In this case, puzzle piece 24 is shown with joint 64 which is identical to joint 26.

To interconnect joints 26 and 64, joint 64 is inserted into joint 26 in the direction indicated by arrow 66 in a manner in which the pieces 22 and 24 are transverse to each other. Since the pieces 22 and 24 are made from a soft and slightly flexible material, as described below, the legs 72 and 74 of joint 64 can be flexed to expand the opening defined by its U-shaped mortise to allow the locking bumps 68 and 70 of joint 64 to be passed outside the width or thickness of piece 22 and to be fitted inside a space 76 defined by the bottom edge 36, the inner side edges 40, 42, and the locking bumps 60, 62 of joint 26. The locking bumps 60 and 62 are adapted to be fitted inside a similar space 78 in joint 64 in the same manner.

Alternatively, the profile of bumps 60, 62, 68 and 70 can be made smaller so that the interconnection of joints 26 and 64 can also be accomplished by flexing legs 72 and 74 of joint 64 to expand the opening of the mortise to allow the locking bumps 68 and 70 of joint 64 to be passed outside the width or thickness of the piece 22 and to grip the body of piece 22. Likewise, the locking bumps 60 and 62 are passed outside the width or thickness of the piece 24 and to grip the body of piece 24.

Thus, the locking bumps provided in the joints of the pieces 22 and 24 perform two functions: (1) to define a space within which the bumps of an interconnecting joint can be fitted, and (2) to provide a secure interconnection of the two joints by fitting the bumps inside the space of the interconnecting joint (or to grip the body of another piece). The supporting protrusions 56 and 57 are therefore useful in preventing the legs 48 and 50, respectively, from snapping or breaking from excessive flexing of these legs 48, 50 during the interconnection. However, it is not necessary to provide protrusions to support all the legs. For example, as explained in my co-pending application Ser. No. 08/584,519, certain shorter legs do not require such support. It will also be appreciated that joint 28 having only one bump 63 can be utilized in the same manner described above to interconnect other joints having one or two locking bumps.

Figure 2B:
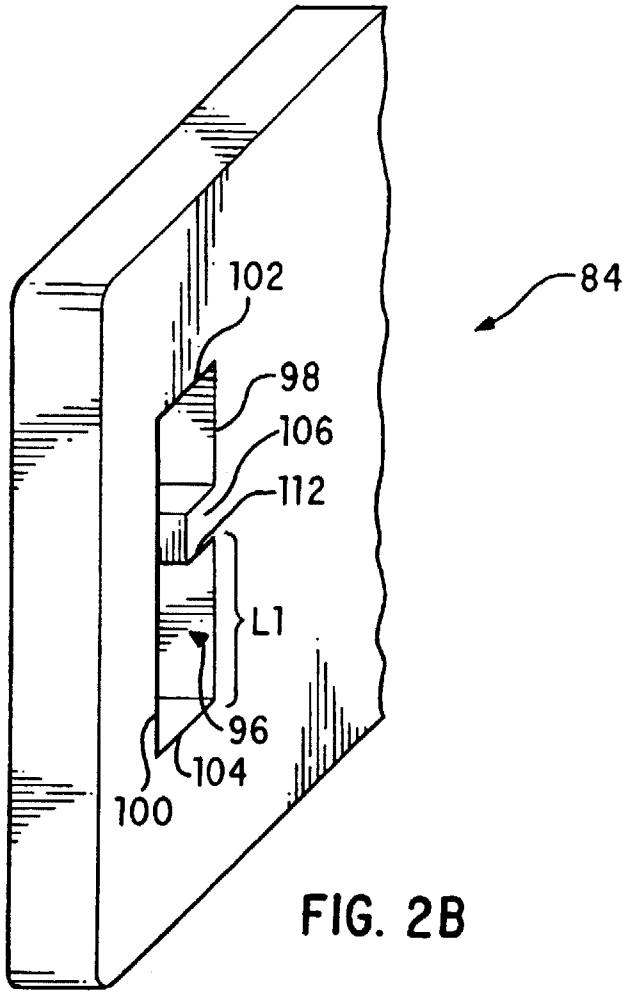
FIGS. 2A and 2B illustrate perspective views of portions of two interconnecting puzzle pieces according to a second embodiment of the present invention.
Figure 2A:
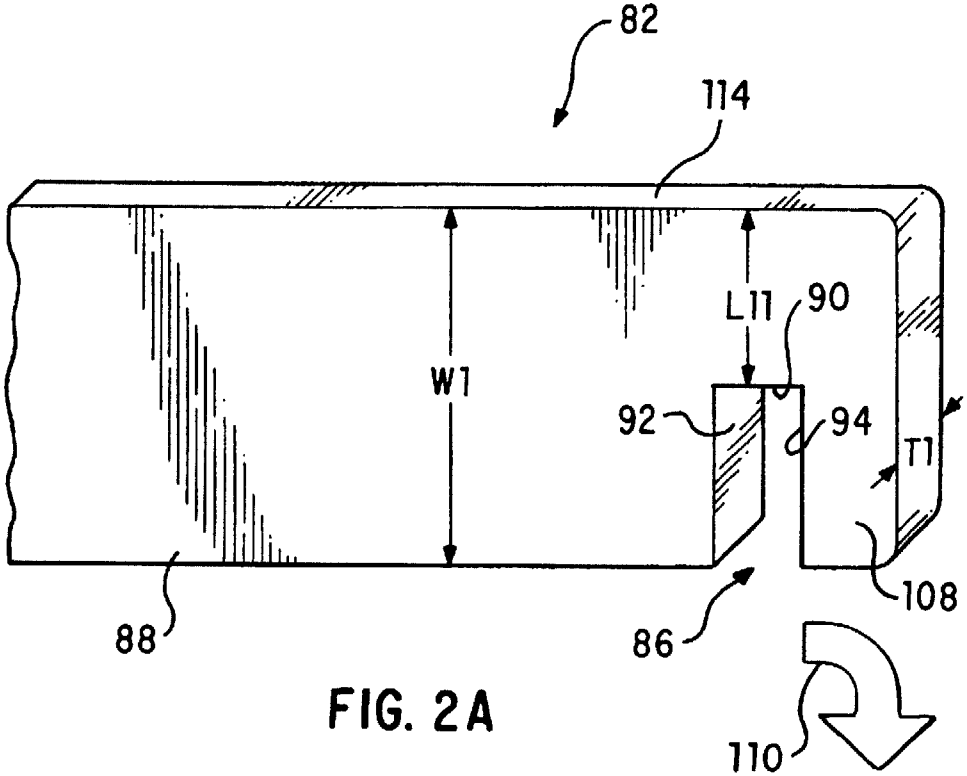

A second preferred embodiment of a pair of interconnecting puzzle pieces 82 and 84 is shown in FIGS. 2A and 2B. The first piece 82 has a joint 86 having a substantially U-shaped mortise part that is cut out of the outer side edge 88 of piece 82. The U-shaped mortise part has a bottom edge 90 connected by two inner side edges 92 and 94.

The second piece 84 has a substantially rectangular or elongated aperture 96 cut out from its body. The aperture 96 has two long edges 98, 100 connected by two short edges 102, 104. A substantially rectangular or square ridge 106 is provided along long edge 98 extending inwardly towards the aperture 96. The aperture 96 is dimensioned such that the length of short edges 102 and 104 is slightly larger than the thickness T1 of piece 82. In addition, the distance L1 along the long edge 98 from the bottom short edge 104 to ridge 106 is preferably slightly larger than the distance L11 from the outer side edge 114 to the bottom edge 90 of joint 86.

The aperture 96 is therefore dimensioned to interconnect the joint 86 of piece 82 to piece 84. To accomplish the interconnection, leg 108 of piece 82 is inserted through aperture 96 between ridge 106 and the bottom short edge 104. Piece 82 is then turned in the direction shown by arrow 110 and fitted inside aperture 96 such that the outer side edge 114 of piece 82 abuts or is adjacent the bottom 112 of ridge 106 and the bottom edge 90 of joint 86 abuts or rests adjacent the bottom short edge 104. Thus, ridge 106 acts as a stop or locking mechanism to retain joint 86 securely within aperture 96.

The ridge 106 can be made to extend any distance into aperture 96. If ridge 106 extends into more than half the width of the aperture 96, joint 86 can also be interconnected to piece 84 at aperture 96 by first turning piece 82 by 180 degrees so that the opening of joint 86 faces upwardly, then inserting leg 108 of piece 82 through aperture 96 between the ridge 106 and the bottom short edge 104, and then turning piece 82 in a direction opposite to that shown by arrow 110 and fitting piece 82 inside aperture 96 such that the outer side edge 114 of piece 82 abuts or is adjacent the bottom short edge 104 and the bottom edge 90 of joint 86 abuts or rests adjacent the bottom 112 of ridge 106.

Figures 3A, 3B, 3C, 3D:
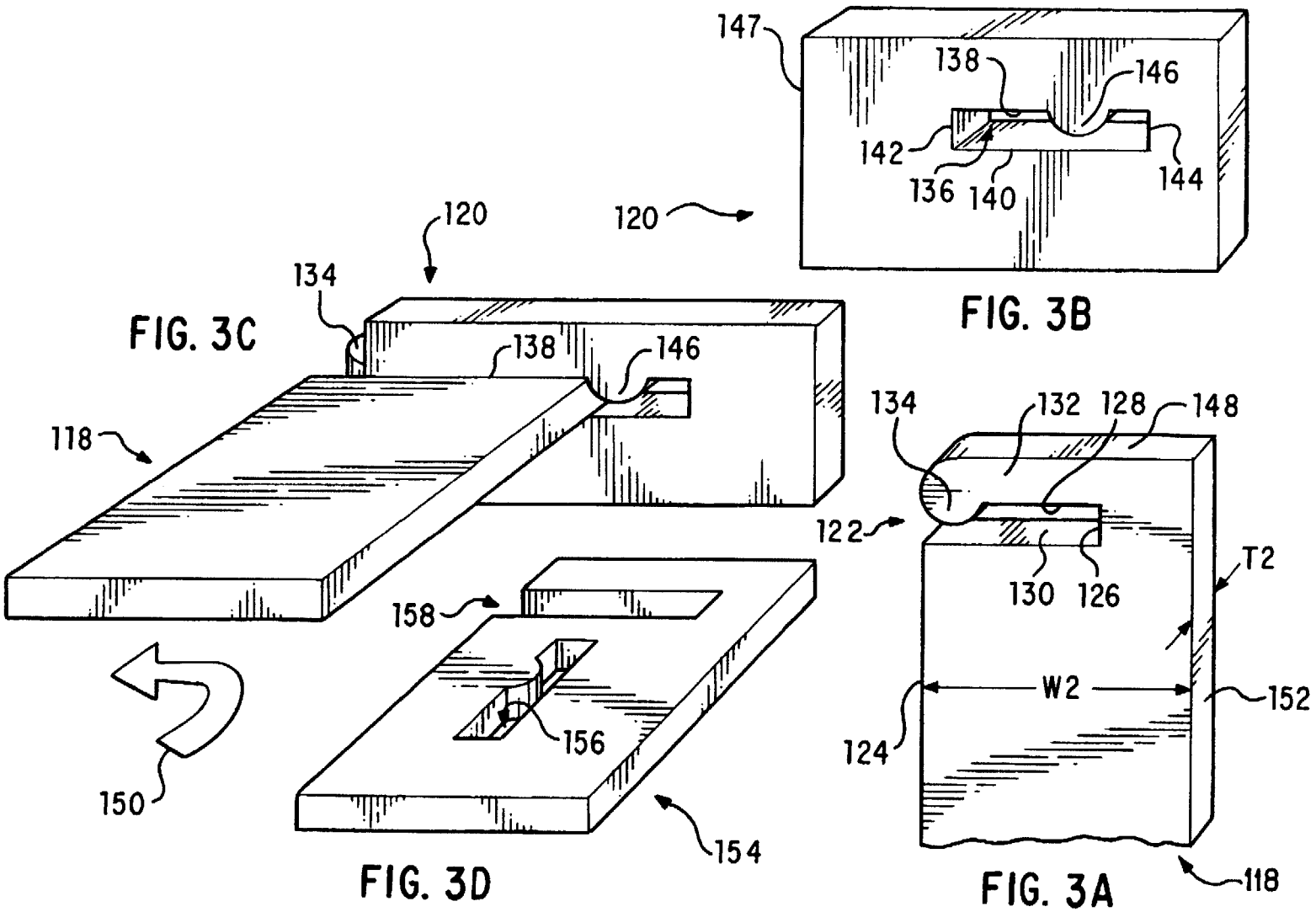
FIGS. 3A–3C illustrate perspective views of portions of two interconnecting puzzle pieces according to a third embodiment of the present invention, and how these pieces are connected.
FIG. 3D illustrates a modification of the puzzle pieces of the third embodiment of FIGS. 3A–3C.

A third preferred embodiment of a pair of interconnecting puzzle pieces 118 and 120 is shown in FIGS. 3A and 3B. The first piece 118 has a joint 122 having a substantially U-shaped mortise part that is cut out of the outer side edge 124 of piece 118. The U-shaped mortise part has a bottom edge 126 connected by two inner side edges 128 and 130. A leg 132 is defined by the inner side edge 128 and an outer side edge 148. A bulbous or enlarged end 134 is provided at the end of leg 132 adjacent the outer side edge 124 and extends into the opening of the U-shaped mortise part.

The second piece 120 has a substantially rectangular or elongated aperture 136 cut out from its body. The aperture 136 is very similar to aperture 96 of piece 84 in that it has two long edges 138, 140 connected by two short edges 142, 144. A bulbous or curved ridge 146 is provided along long edge 138 extending inwardly towards the aperture 136. The aperture 146 is dimensioned such that the length of long edges 138 and 140 is larger than the width W2 of piece 118 (see FIG. 3C), and the length of short edges 142 and 144 is slightly larger than the thickness T2 of piece 118.

The aperture 136 is therefore dimensioned to interconnect joint 122 of piece 118 in a manner similar to that for pieces 82 and 84 of FIGS. 2A and 2B. To accomplish the interconnection, leg 132 of piece 118 is inserted through aperture 136 between ridge 146 and the short edge 142 as shown in FIG. 3C. The piece 118 is then turned in the direction shown by arrow 150 and fitted inside aperture 136 such that the outer side edge 152 of piece 118 abuts or rests adjacent the ridge 146, the bottom edge 126 of joint 122 abuts or rests adjacent the short edge 142, and bulbous end 134 extends beyond the side edge 147 of piece 120 and engages it. Thus, ridge 146 acts as a stop or locking mechanism to retain the joint 122 securely within aperture 136, and bulbous end 134 grips the side edge 147 of piece 120 to provide a secure connection of the joint 122 to the piece 120.

If ridge 146 extends into more than half the width of the aperture 136, joint 122 can also be interconnected to piece 120 at aperture 136 by first turning the orientation of piece 118 in FIG. 3A by 180 degrees, then inserting leg 132 of piece 118 through aperture 136 between the ridge 146 and the short edge 142, and then turning piece 118 in a direction opposite to that shown by arrow 150 and fitting piece 118 inside aperture 136 such that the outer side edge 152 of piece 118 abuts or rests adjacent the short edge 142 and the bottom edge 126 of joint 122 abuts or rests adjacent the ridge 146. Bulbous end 134 would be fitted in aperture 136 between ridge 146 and short edge 144.

FIG. 3D shows an alternative piece 154 which has an aperture 156 which is the same as the aperture 136, and whose joint 158 is the same as joint 122 except that no bulbous end is provided. Thus, it will be appreciated that different ones or variations of the features of the matching joints and apertures described in the present invention can be used with any other piece without departing from the spirit and scope of the present invention.

Figures 4A, 4B, 4C:
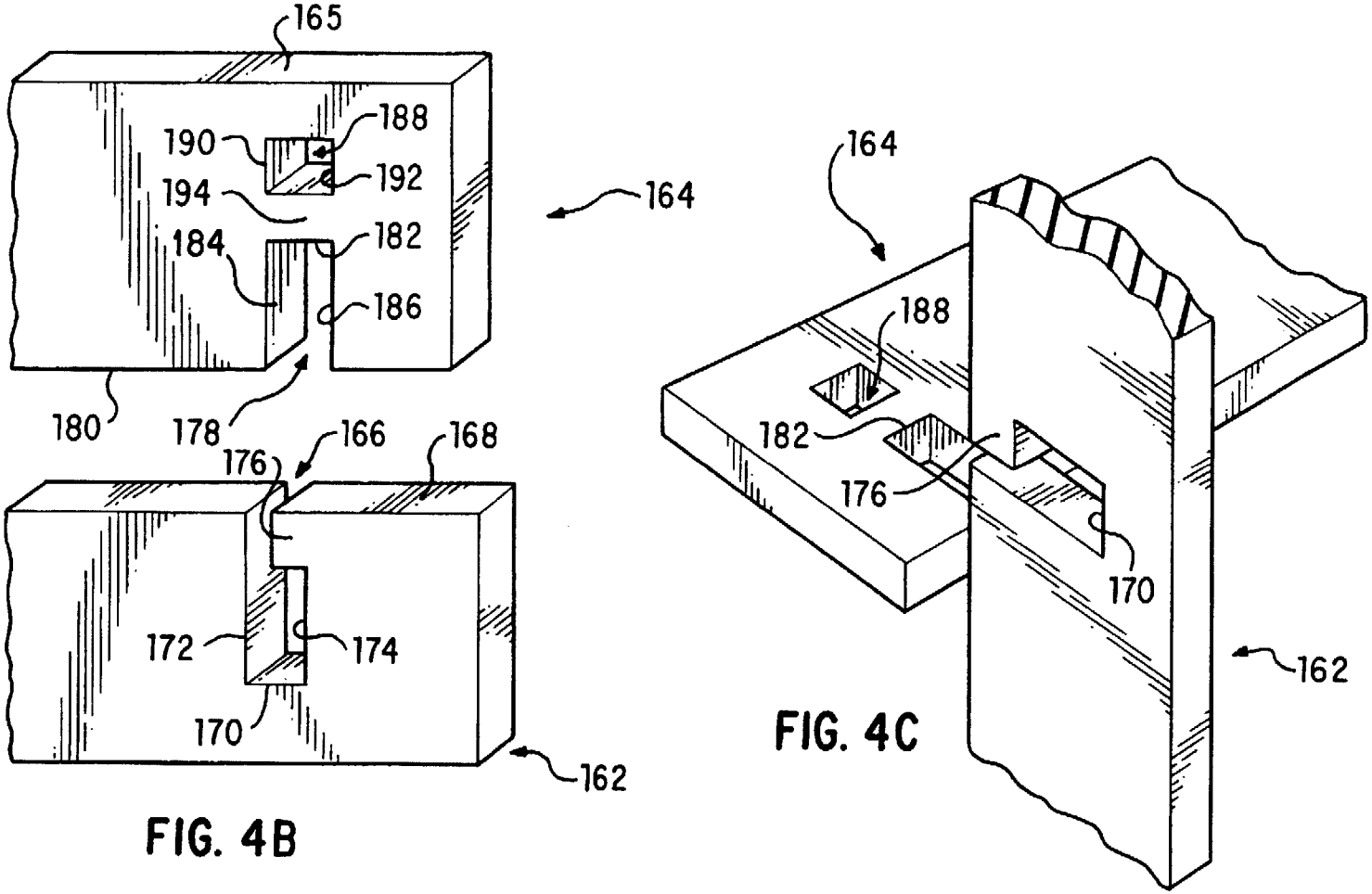
FIGS. 4A–4D illustrate perspective views of portions of two interconnecting puzzle pieces according to a fourth embodiment of the present invention, and how these pieces are connected.

A fourth preferred embodiment of a pair of interconnecting puzzle pieces 162 and 164 is shown in FIGS. 4A–4C. The first piece 162 has a joint 166 having a substantially U-shaped mortise part that is cut out of the outer side edge 168 of piece 162. The U-shaped mortise part has a bottom edge 170 connected by two inner side edges 172 and 174. The end 176 adjacent inner side edge 174 and outer side edge 168 is enlarged and extends into the opening of the U-shaped mortise part.

The second puzzle piece 164 also has a joint 178 having a substantially U-shaped mortise part that is cut out of the outer side edge 180 of the piece 164. The U-shaped mortise part has a bottom edge 182 connected by two inner side edges 184 and 186. In addition, an aperture 188 is cut out from the body of the piece 164 and has side edges 190 and 192 that are each along substantially the same vertical line as inner side edges 184 and 186, respectively. A wall 194 separates or divides the aperture 188 from bottom edge 182 of joint 178. The dimensions of the U-shaped mortises for joints 166 and 178 are preferably about the same.

To interconnect pieces 162 and 164, joint 166 is inserted into joint 178 such that pieces 162 and 164 are transverse to each other (see FIG. 4C). Since pieces 162 and 164 are made from a soft and slightly flexible material, as described below, the opening defined by the U-shaped mortise of joint 166 can be flexed to expand the opening to allow enlarged end 176 of joint 166 to be passed outside the width or thickness of piece 164 and to be fitted inside aperture 188. When interconnected, bottom edges 170 and 182 of joints 166 and 178, respectively, preferably abut or rest adjacent each other. Thus, fitting the enlarged end 176 inside aperture 188 provides a secure interconnection between joints 166 and 178. As such, enlarged end 176 and aperture 188 are preferably shaped and dimensioned to allow enlarged end 176 to fit inside aperture 188.

Figure 4D:
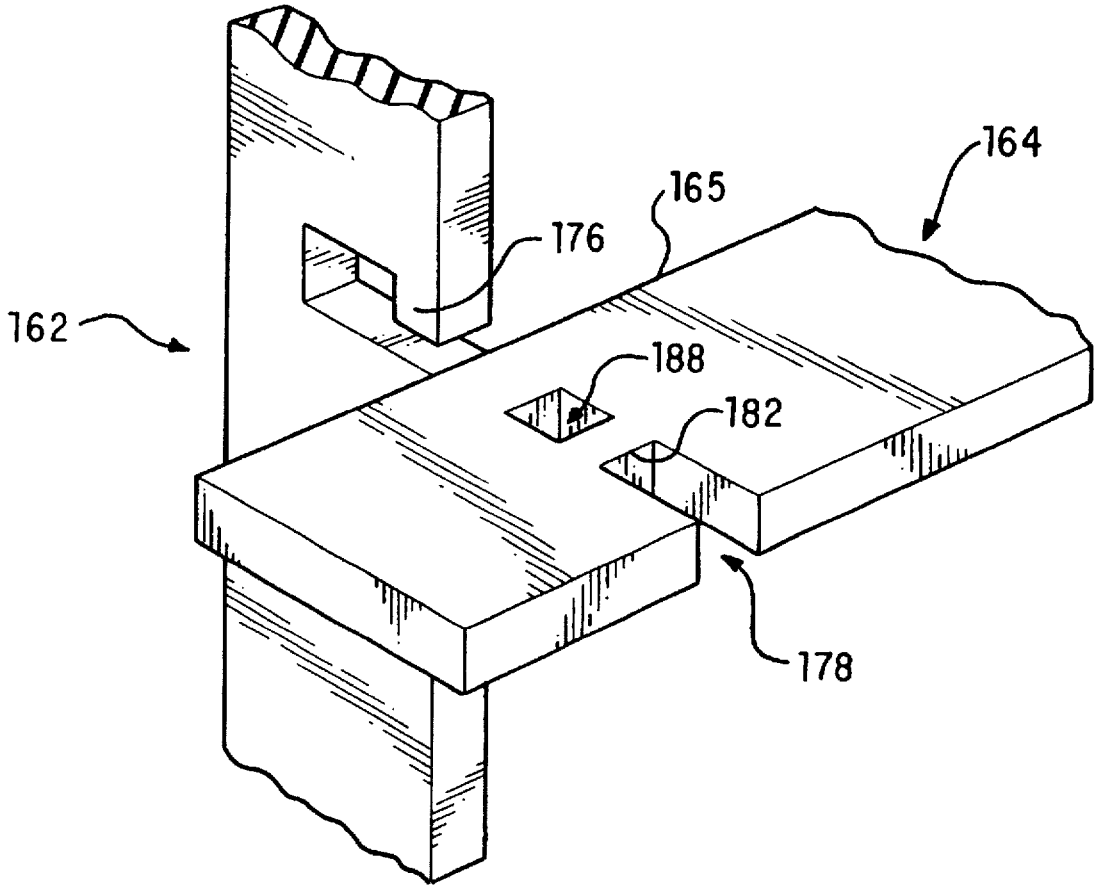

Pieces 162 and 164 can be interconnected in another way. Referring to FIG. 4D, the body of piece 164, starting from outer side edge 165, is inserted into joint 166. Since pieces 162 and 164 are made from a soft and slightly flexible material, as described below, the opening defined by the U-shaped mortise of joint 166 can be flexed to expand the opening to allow enlarged end 176 of joint 166 to be passed outside the width or thickness of piece 164 and to be fitted inside joint 178. When so interconnected, bottom edge 170 joint 166 abuts or rests adjacent outer side edge 165, and enlarged end 176 abuts or rests against bottom edge 182 of joint 178. Thus, fitting the enlarged end 176 inside joint 178 provides a secure interconnection between joints 166 and 178.

Figure 5A:
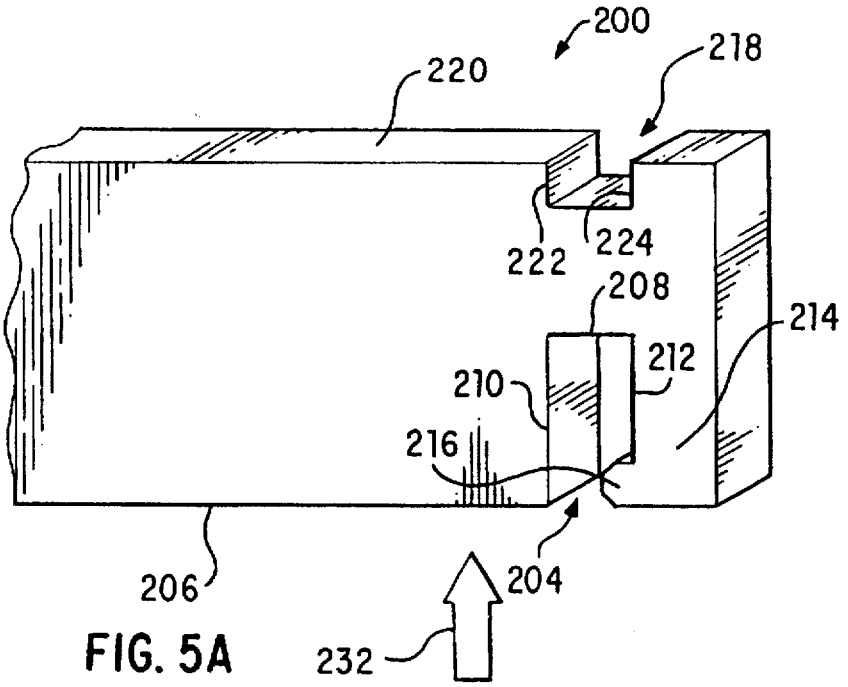
FIGS. 5A and 5B illustrate perspective views of portions of two interconnecting puzzle pieces according to a fifth embodiment of the present invention.
Figure 5B:
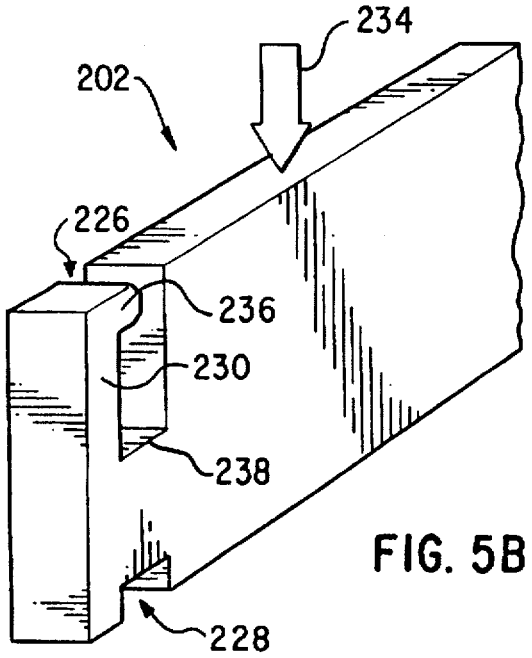

A fifth preferred embodiment of a pair of interconnecting puzzle pieces 200 and 202 is shown in FIGS. 5A and 5B. The first piece 200 has a joint 204 having a substantially U-shaped mortise part that is cut out of the outer side edge 206 of piece 200. The U-shaped mortise part has a bottom edge 208 connected by two inner side edges 210 and 212 and defining a leg 214. An enlarged end 216 is provided at the end of leg 214 adjacent inner side edge 212 and outer side edge 206, and extends into the opening of the U-shaped mortise part. A groove 218 is cut from the opposing outer side edge 220 and has inner side edges 222 and 224 that are each along substantially the same vertical line as inner side edges 210 and 212, respectively.

The second piece 202 may be identical to piece 200, and has a joint 226 that is identical to joint 204, and a groove 228 that is identical to groove 218. To interconnect pieces 200 and 202, joints 204 and 226 are transversely inserted into each other (see arrows 232 and 234). Since pieces 200 and 202 are made from a soft and slightly flexible material, as described below, legs 214 and 230 can be flexed to expand the openings defined by the U-shaped mortises of joints 204 and 226 to allow enlarged ends 216 and 236 of joints 204 and 226, respectively, to be passed outside the width or thickness of the other piece and to be fitted inside grooves 228 and 218, respectively. When interconnected, bottom edges 208 and 238 of joints 204 and 226, respectively, preferably abut or rest adjacent each other. Thus, fitting enlarged ends 216 and 236 inside grooves 228 and 218, respectively, provide a secure interconnection between joints 204 and 206. As such, enlarged ends 216, 236 and grooves 218, 228 are preferably shaped and dimensioned to allow the enlarged ends to fit inside the grooves. The resulting connection may be a right-angled connection between pieces 200 and 202.

Figure 6B:
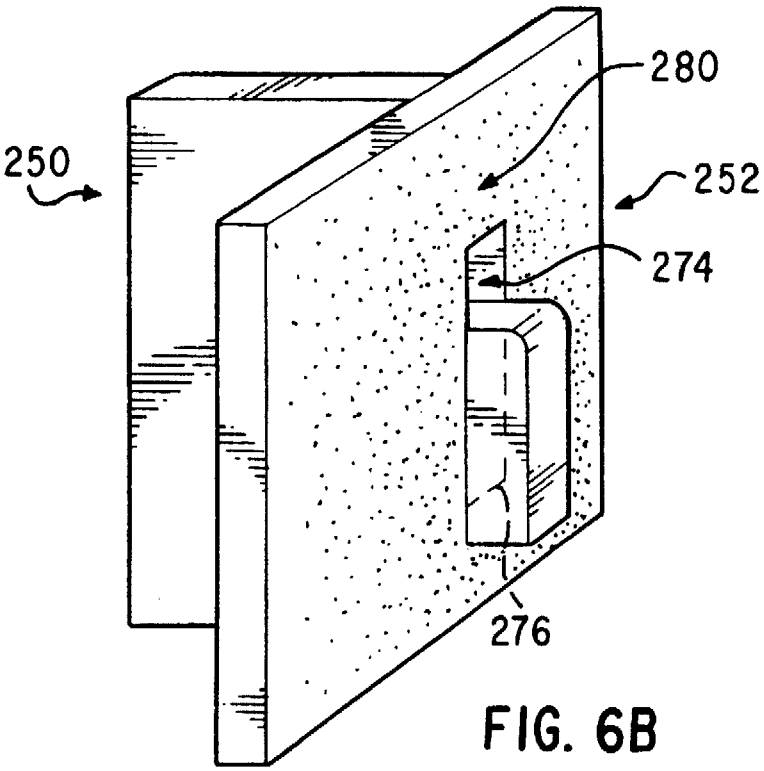
FIGS. 6A and 6B illustrate perspective views of portions of two interconnecting puzzle pieces according to a sixth embodiment of the present invention and how they are connected.
Figure 6A:
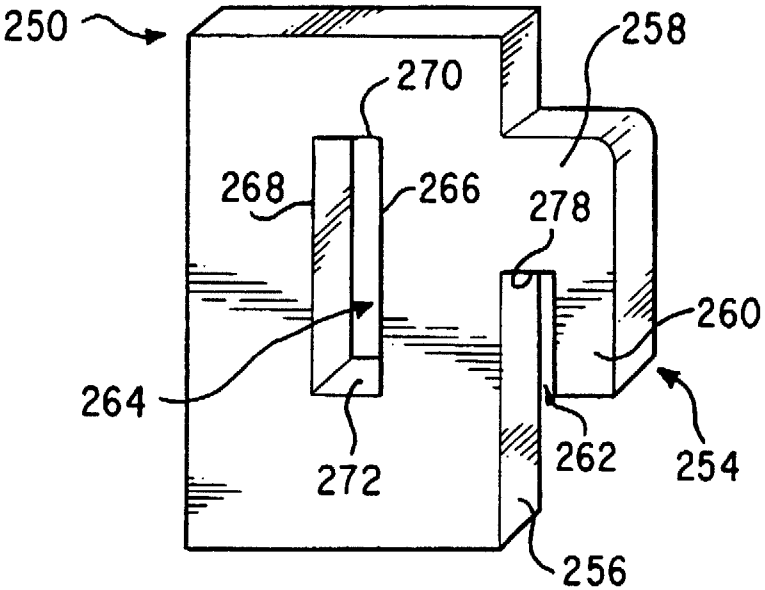

A sixth preferred embodiment of a pair of interconnecting puzzle pieces 250 and 252 is shown in FIGS. 6A and 6B. The first piece 250 has a joint 254 which is configured as a dogleg or L-shaped extension extending from an outer side edge 256 of piece 250. Extension 254 has a short stem 258 extending transversely from outer side edge 256 and a leg 260 extending from stem 258 in a direction substantially parallel to outer side edge 256 to define a gap 262 therebetween. Piece 250 may also optionally include an elongated aperture 264 which has two long edges 266 and 268 connected by two short edges 270 and 272.

The second piece 252 preferably has at least one aperture 274 which is substantially identical in size and configuration with aperture 264. Aperture 274 is configured and dimensioned so that its short edges are preferably slightly wider than the width or thickness of extension 254 to allow extension 254 to pass therethrough.

To interconnect pieces 250 and 252, leg 260 of extension 254 is inserted through aperture 274 and the piece 250 slid downwardly so that a portion of the body of piece 252 is disposed or engaged in the gap 262, or gripped by the outer side edge 256 and the leg 260, to provide a secure interconnection. When interconnected, bottom edge 276 of aperture 274 and inner edge 278 of extension 254 preferably abut or rest adjacent each other. Alternatively, the connection may be achieved by reversing extension 254 to dispose the upper part of the body of piece 252, such as at 280, inside the gap 262. The stem 258 can also be rotated by ninety degrees to the left or right within aperture 274 from the position shown in FIG. 6B to provide piece 250 at different planes with respect to piece 252.

Figure 7B:
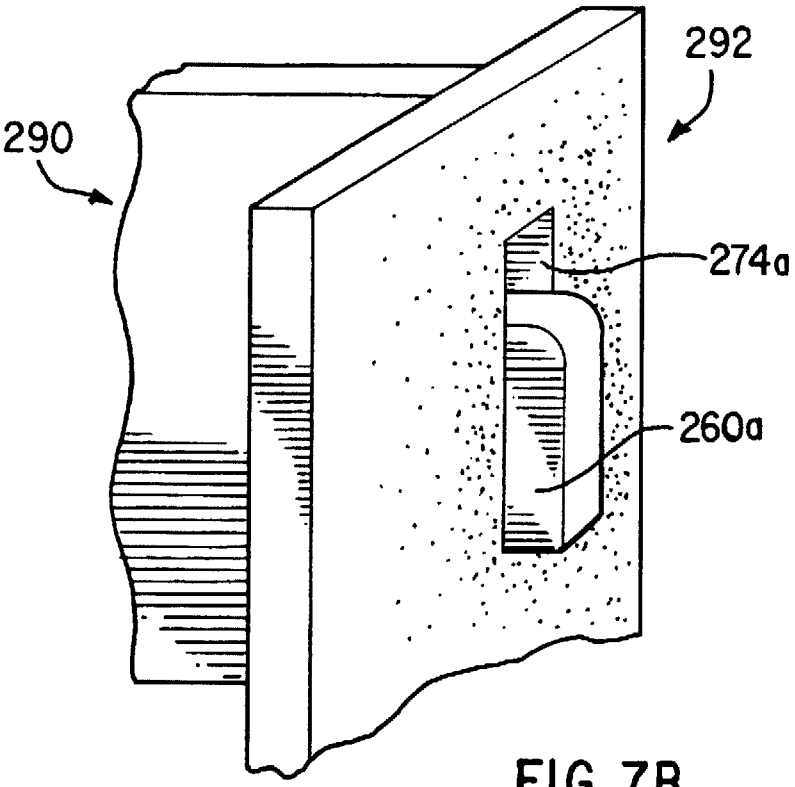
FIGS. 7A and 7B illustrate perspective views of portions of two interconnecting puzzle pieces according to a seventh embodiment of the present invention and how they are connected.
Figure 7A:
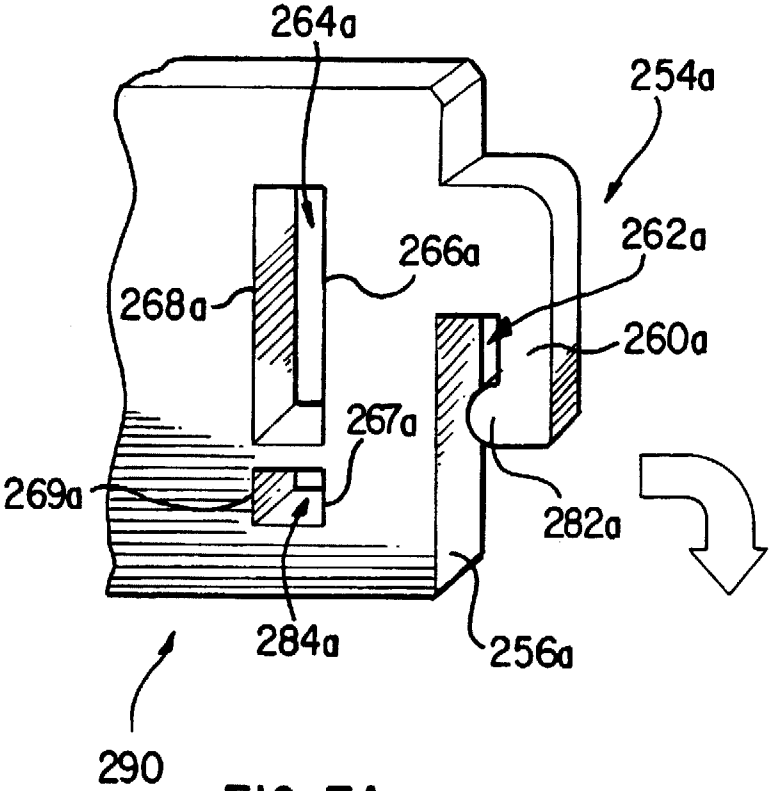

A seventh preferred embodiment of a pair of interconnecting puzzle pieces 290 and 292 is shown in FIGS. 7A and 7B. Pieces are 290 and 292 are very similar to pieces 250 and 252, respectively, except that the leg **260*a* of extension 254*a* has an enlarged end 282*a* and that a second aperture 284*a* is located below each elongated aperture 264*a*. The edges 267*a* and 269*a* of aperture 284*a* are along the same vertical line as the long edges 266*a* and 268*a*, respectively, of aperture 264*a***.

To interconnect pieces 290 and 292 at aperture **274*a*, leg 260*a* of extension 254*a* is inserted through the aperture 274*a* and the piece 290 slid downwardly so that a portion of the body of piece 292 is disposed in the gap 262*a* (or gripped by the outer side edge 256*a* and the leg 260*a*), with the enlarged end 282*a* of leg 260*a* fitted inside second aperture 284*a* of piece 292** to provide a secure interconnection.

Figure 8B:
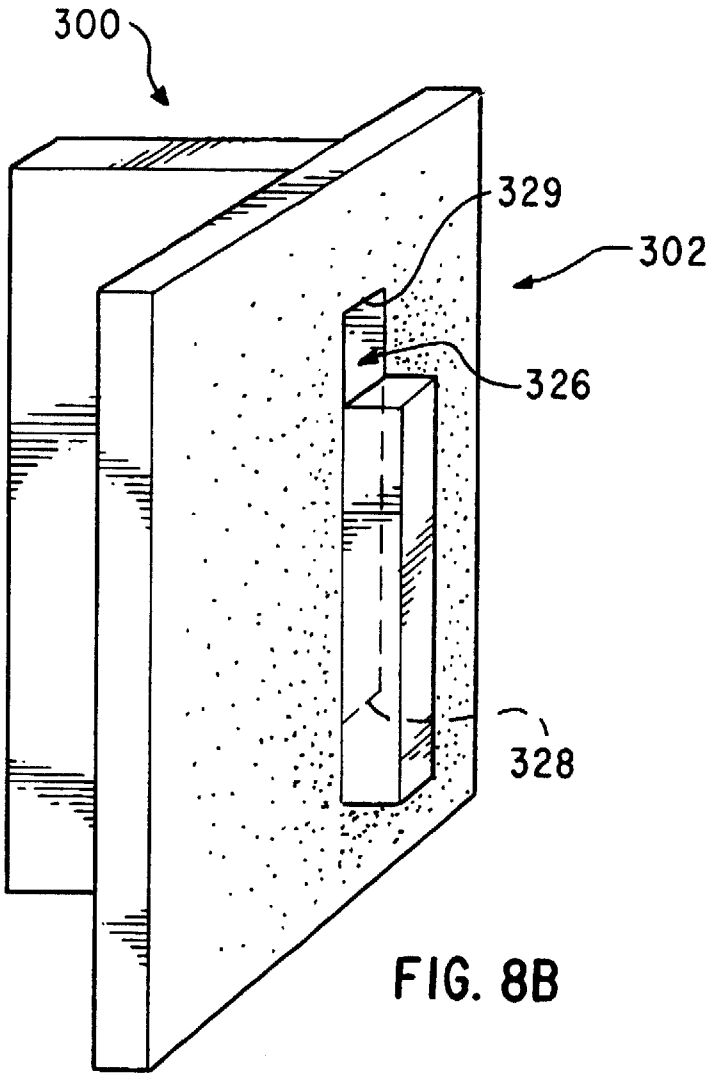
FIGS. 8A and 8B illustrate perspective views of portions of two interconnecting puzzle pieces according to an eighth embodiment of the present invention and how they are connected.
Figure 8A:
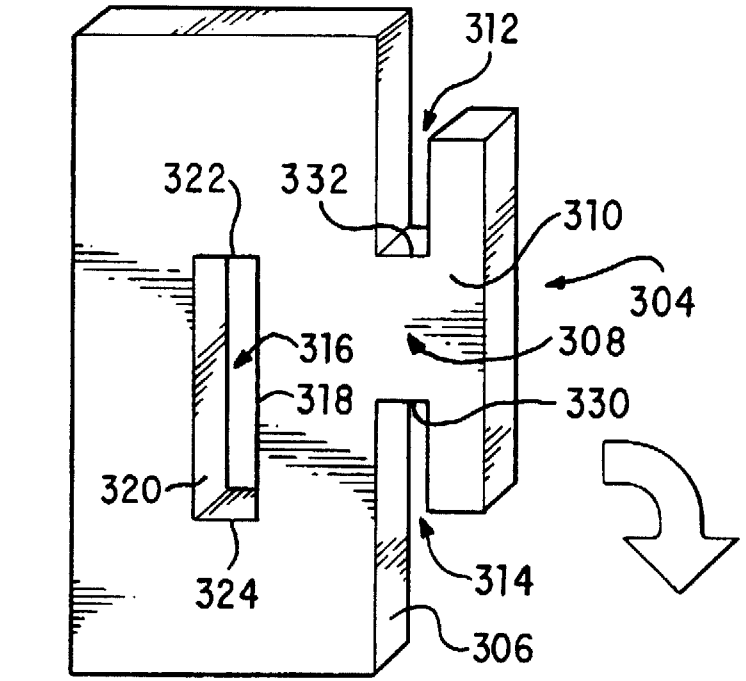

An eighth preferred embodiment of a pair of interconnecting puzzle pieces 300 and 302 is shown in FIGS. 8A and 8B. The first piece 300 has a joint 304 which is configured as a T-shaped extension extending from an outer side edge 306. The T-shaped extension 304 has a short stem 308 extending transversely from the outer side edge 306 and a bar 310 (which defines two legs) extending in both directions from the stem 308 substantially parallel to the outer side edge 306 to define gaps 312 and 314 therebetween. The piece 300 may also optionally include an elongated aperture 316 which has two long edges 318 and 320 connected by two short edges 322 and 324.

The second piece 302 preferably has at least one aperture 326 which is substantially identical in size and configuration with aperture 316. The aperture 326 is configured and dimensioned so that its short edges are preferably slightly wider than the width or thickness of the extension 304 to allow the extension 304 to pass therethrough.

To interconnect pieces 300 and 302, bar 310 is inserted through aperture 326 and piece 300 is slid downwardly or upwardly so that a portion of the body of piece 302 is disposed in either the gap 314 or the gap 312, respectively (i.e., gripped by the outer side edge 306 and the bar 310) to provide a secure interconnection. When interconnected, bottom edge 328 or top edge 329 of aperture 326 and inner edge 330 or 332, respectively, of extension 304 preferably abut or rest adjacent each other.

Figures 9A, 9B, 9C, 9D:
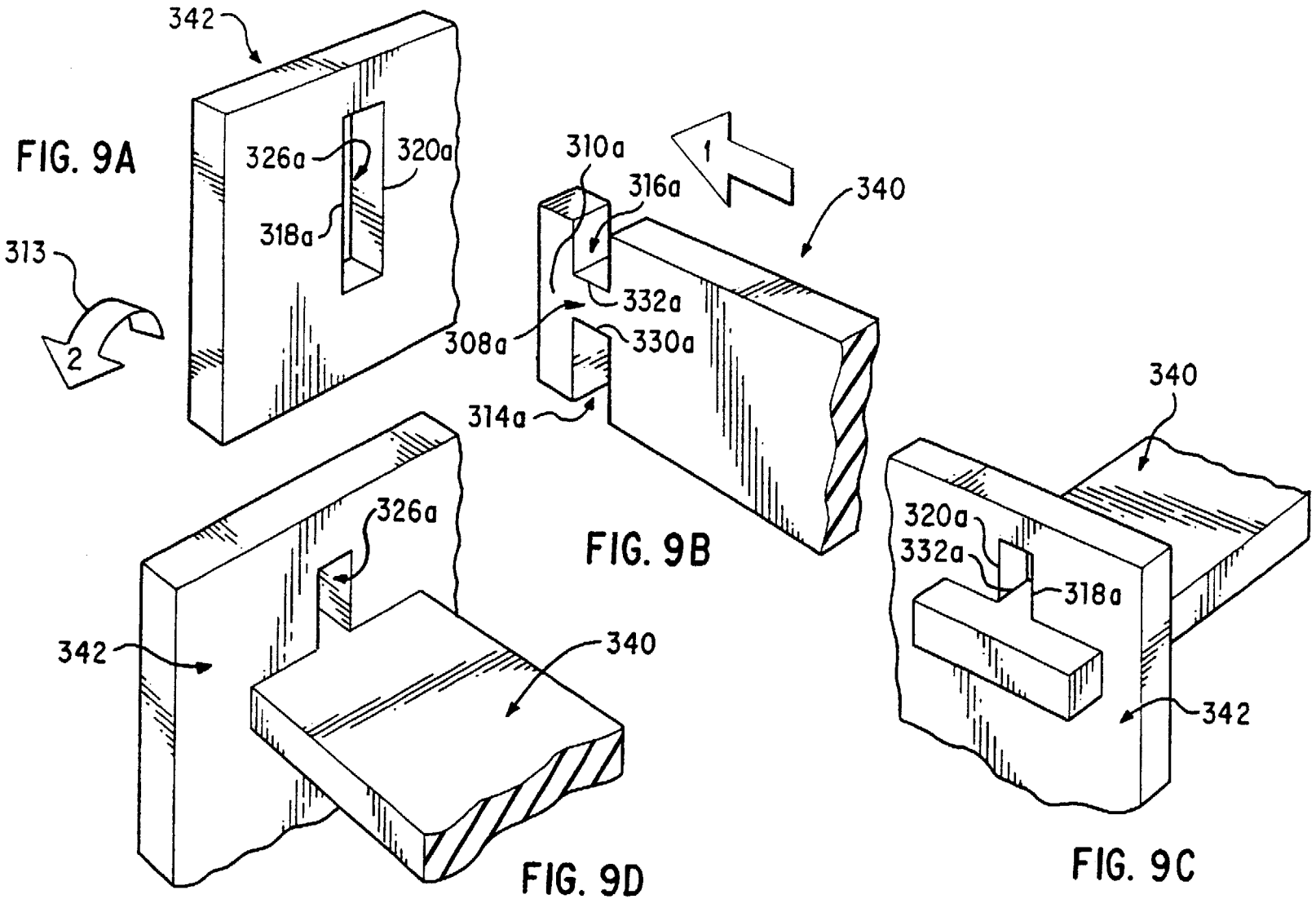
FIGS. 9A–9D illustrate perspective views of portions of two interconnecting puzzle pieces according to a ninth embodiment of the present invention, and how these pieces are connected.

Alternatively, stem 308 of extension 304 can be configured and dimensioned to allow piece 300 to be rotated with respect to piece 302 after the interconnection. This is illustrated in connection with pieces 340 and 342 according to a ninth preferred embodiment shown in FIGS. 9A–9D. Referring to FIGS. 9A and 9B, stem **308*a* is narrower than stem 308. To interconnect pieces 340 and 342, bar or extension 310*a* is inserted through aperture 326*a* and rotated (see arrow 313) to the position shown in FIGS. 9C and 9D so that portions of the body of piece 342 are disposed in both gaps 314*a* and 316*a* on either side of aperture 326*a* to provide a secure interconnection. Optionally, piece 340 may also be slid downwardly or upwardly before or after rotation thereof to effect the connection at a different vertical level along aperture 326*a*. When interconnected, the long edges 318*a* and 320*a* of aperture 326*a* are closely aligned with or adjacent inner edges 330*a* and 332*a* of extension 310*a***.

Figures 10A, 10B:
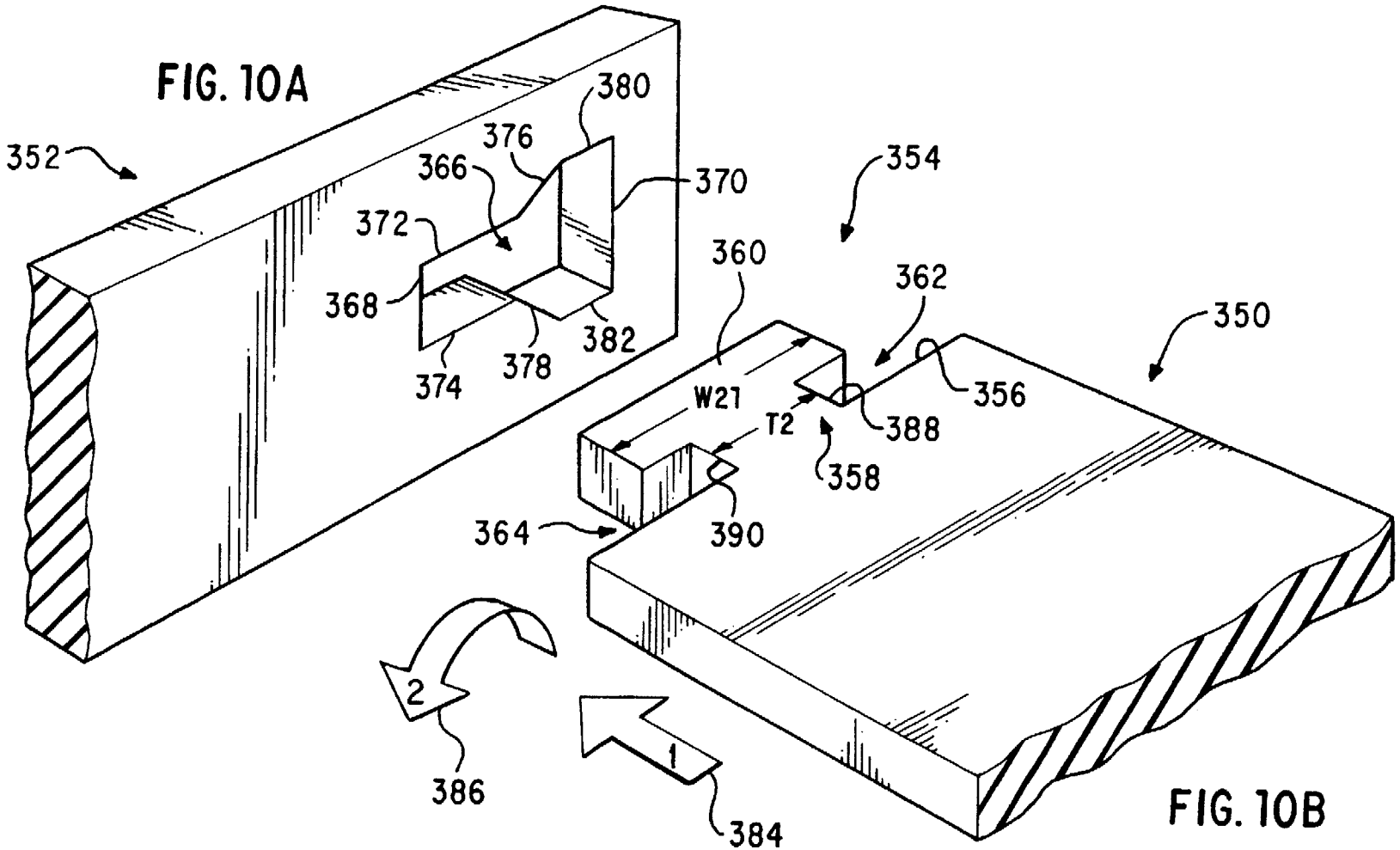
FIGS. 10A and 10B illustrate perspective views of portions of two interconnecting puzzle pieces according to a tenth embodiment of the present invention.

A tenth preferred embodiment of a pair of interconnecting puzzle pieces 350 and 352 is shown in FIGS. 10A and 10B. The first piece 350 has a joint 354 which is configured as a T-shaped extension extending from an outer side edge 356. Extension 354 has a short stem 358 extending from the outer side edge 356 and a bar 360 (defining two legs) extending in both directions from stem 358 in a manner substantially parallel to the outer side edge 356 to define gaps 362 and 364 therebetween.

The second piece 352 preferably has at least one substantially key-shaped aperture 366 which is wider at one end than at the other end. Aperture 366 has a left edge 368 which is shorter than a right edge 370. A pair of longitudinal edges 372, 374 extend from the left edge 368 and are each connected to a left end of a slanted edge 376, 378, respectively. Upper and lower edges 380 and 382 extend from the right edge 370 and are each connected to a right end of the slanted edges 376, 378, respectively. Aperture 366 is configured and dimensioned so that right edge 370 is preferably slightly longer than the thickness T2 of the stem 358, left edge 368 is preferably shorter than the thickness T2 of the stem 358, and the total length of its longitudinal edge 372, slanted edge 376 and upper edge 380 is slightly longer than the width W21 of the bar 360 to allow the bar 360 to pass therethrough. It will be appreciated that slanted edges 376, 378 can be replaced by substantially vertical edges, or longitudinal edges 372, 374 can be slanted or angled to connect upper and lower edges 380 and 382, respectively.

To interconnect pieces 350 and 352, bar 360 is inserted along its width W21 through the length of aperture 366 in the direction shown by arrow 384 in FIGS. 10A and 10B. Piece 350 is then slid to the right so that the inner edge 388 or 390 of its stem 358 is adjacent right edge 370, and piece 350 is then rotated by ninety degrees in the direction shown by arrow 386 so that portions of the body of piece 352 adjacent the right edge 370 of aperture 366 are disposed in gaps 362 and 364 to provide a secure interconnection. When interconnected, upper edge 380 and lower edge 382 of aperture 366 preferably abut or rest adjacent inner edges 388 and 390 of extension 354. Although extension 354 is illustrated as having two legs (forming a bar 360) extending from stem 358, it is also possible to provide extension 354 with only one leg extending in one direction from stem 358.

Figure 11A:
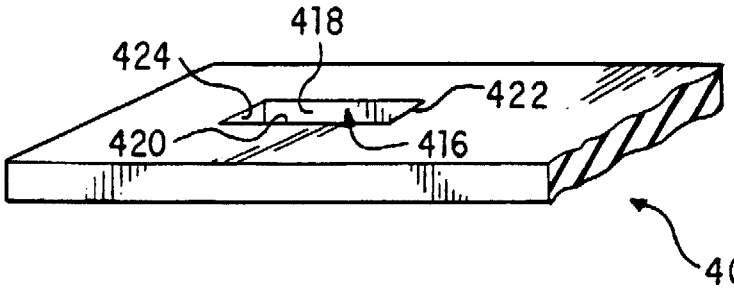
FIGS. 11A and 11B illustrate perspective views of portions of two interconnecting puzzle pieces according to a eleventh embodiment of the present invention.
Figure 11B:
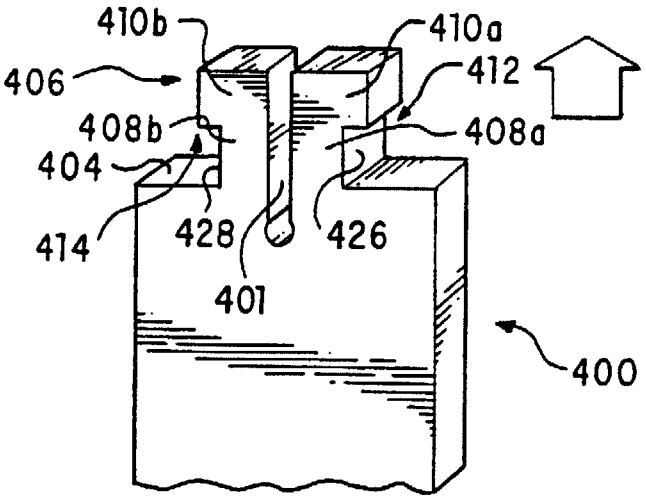
Figure 12F:
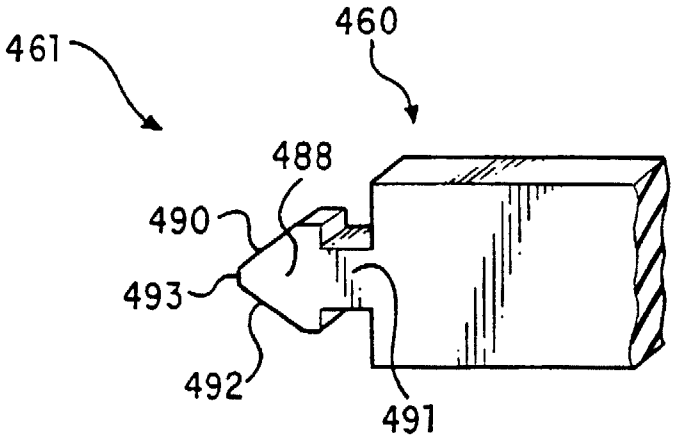
FIGS. 12A–12F illustrate perspective views of interconnecting puzzle pieces according to a twelfth embodiment of the present invention.
Figures 12A, 12B, 12C, 12D, 12E:
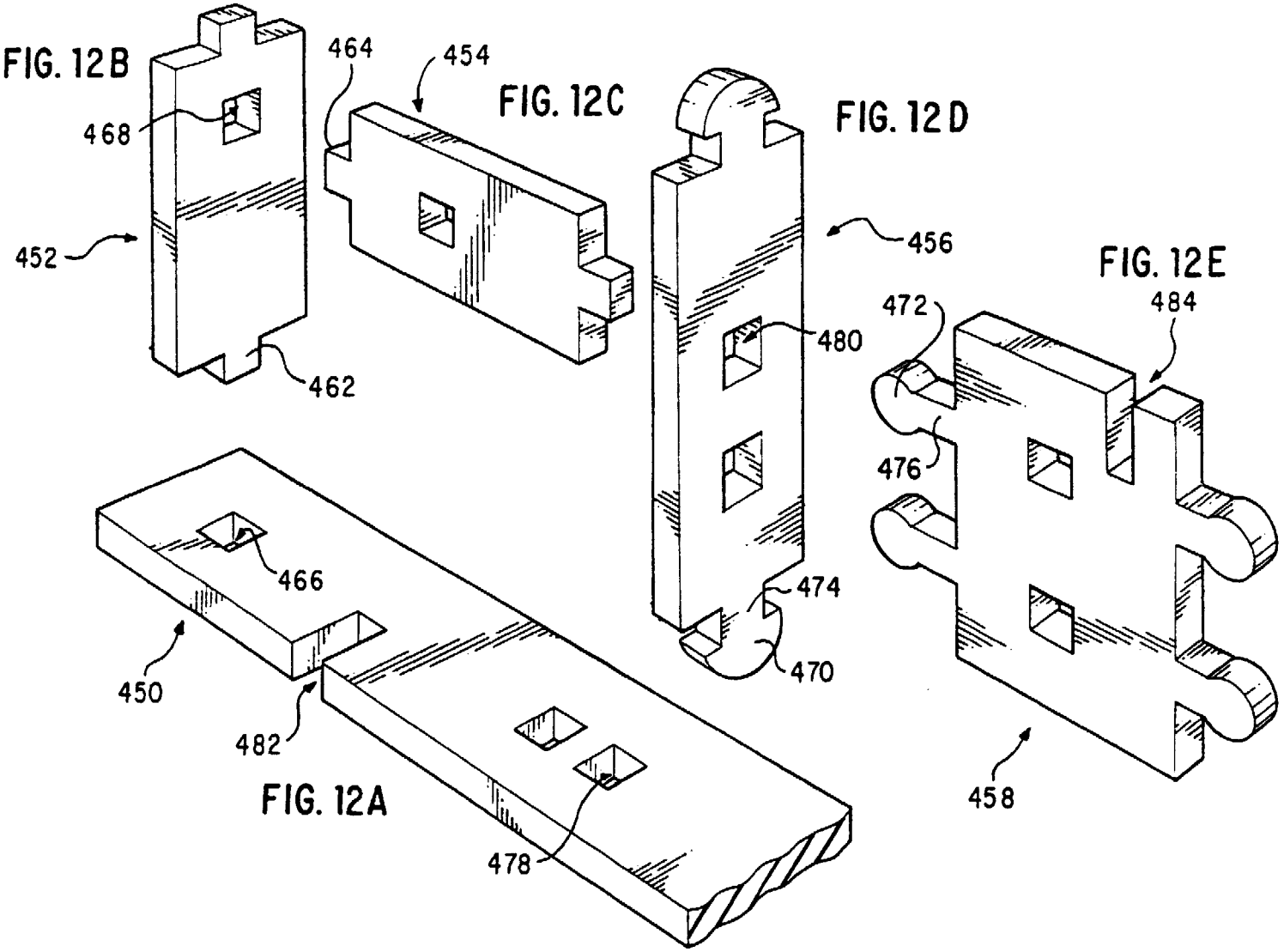

An eleventh preferred embodiment of a pair of interconnecting puzzle pieces 400 and 402 is shown in FIGS. 11A and 11B. The first piece 400 has a joint 406 which is similar to joint 306 of piece 300 (FIG. 8A) in that it is configured as a T-shaped extension extending from an outer side edge 404. However, a gap or slit 401 divides the extension into two separate extensions, each having a stem **408*a*, 408*b* extending from the outer side edge 404 and a leg or bar 410*a*, 410*b* extending in opposite directions from stem 408*a*, 408*b*, respectively, and substantially parallel to the outer side edge 406 to define gaps 412 and 414 therebetween. Gap 401 extends from the top of bars 410*a*, 410*b* into a portion of the body beyond outer side edge 404**.

The second piece 402 preferably has at least one elongated aperture 416 having two long edges 418 and 420 connected by two short edges 422 and 424. Aperture 416 is preferably configured and dimensioned so that its long edges 418, 420 are slightly longer than the width of the combined stems 408*a*, 408*b*, and gap 401, but slightly shorter than the width of the combined bars 410*a*, 410*b* and gap 401.

To interconnect pieces 400 and 402, bars 410*a* and 410*b* are pressed together and inserted through aperture 326. The soft and slightly flexible material of piece 400 combined with the presence of the gap 401 allow stems 408*a*, 408*b* to be flexed inwardly towards each other so that the bars 410*a*, 410*b* when pressed together will have a dimension that is small enough to be inserted through aperture 416. After bars 410*a*, 410*b* have passed through aperture 416, the user releases the grip on bars 410*a*, 410*b* and the stems 408*a*, 408*b* will automatically return to their original position by flexing outwardly so that inner edges 426 and 428 of stems 408*a*, 408*b*, respectively, abut or rest adjacent short edges 422, 424, respectively, of aperture 416 to provide a secure interconnection. In addition, if stems 408*a* and 408*b* are thin enough, such as stem 308*a* of piece 340, stems 408*a*, 408*b* can be rotated within aperture 416 and slid along aperture 416 towards either short edge 422 or short edge 424 to vary the position of piece 400 along aperture 416.

FIGS. 12A–12F illustrate several puzzle pieces according to a twelfth embodiment of the present invention. Connection between each of these pieces is accomplished by slightly deforming an extension or force-fitting the extension to pass the extension through or into an aperture.

For example, pieces 452, 454, 456, 458 and 460 each include at least one joint in the form of an extension that is adapted to be inserted through an aperture to effect an interconnection. Each of these extensions may be provided in a different configuration, and each has a dimension and configuration which is slightly larger than the corresponding dimension and configuration of the aperture through which it is intended to be inserted. Each piece may also have at least one aperture through which it can be interconnected to another piece.

Pieces 452 and 454 each have an extension 462, 464, respectively, which is configured as a simple substantially square or rectangular stem, and which are adapted to be inserted through apertures 466, 468, respectively, that have a substantially square or rectangular configuration slightly smaller than the dimension of the extensions 462, 464. Connection is accomplished by using force to push extensions 462, 464 through apertures 466, 468, respectively. Since the dimension of the apertures are slightly smaller than the dimension of the extensions, the extensions will be securely retained in the apertures.

Similarly, pieces 456 and 458 each have an extension 470, 472, respectively, which is configured as a semi-circle and substantially full circle, respectively, extending from short stems 474, 476, respectively. Extensions 470, 472 are adapted to be inserted through apertures 478, 480, respectively, that have a substantially square or rectangular configuration slightly smaller than the dimension of the extensions 470, 472. Connection is also accomplished by using force to push the curved extensions 470, 472 through apertures 478, 480, respectively, which can be easily accomplished because the curved configurations of the extensions 470, 472 have a somewhat narrower front end which are more easily inserted into apertures 478, 480. Joint 461 of piece 460 has a stem 491 from which extends a substantially arrow-shaped extension 488 having front slanting edges 490, 492 terminating at a connecting sharp point 493 which make it easier to push extension 488 through a slightly smaller aperture. Since the dimension of the apertures are slightly smaller than the dimension of the extensions, the extensions will be securely retained in the apertures. Extensions 470, 472 and 488 each has a stem so that the extensions can actually be inserted entirely through the apertures and emerge at the other side of the apertures with the stems fitted inside the apertures, to provide a secure interconnection.

In addition, U-shaped mortise joints such as joints 482 and 484 may also be provided for transverse interconnection.

When used to retain the body of a piece to provide a secure connection, the gaps (for example, gaps 262, 262*a*, 312, 314, 314*a*, 316*a*, 362, 364, 412 and 414 in FIGS. 6–11) of all of the above described joints are preferably configured and dimensioned to be slightly wider than the thickness of the body of the piece to snugly hold or grip the body.

Figures 13A, 13B:
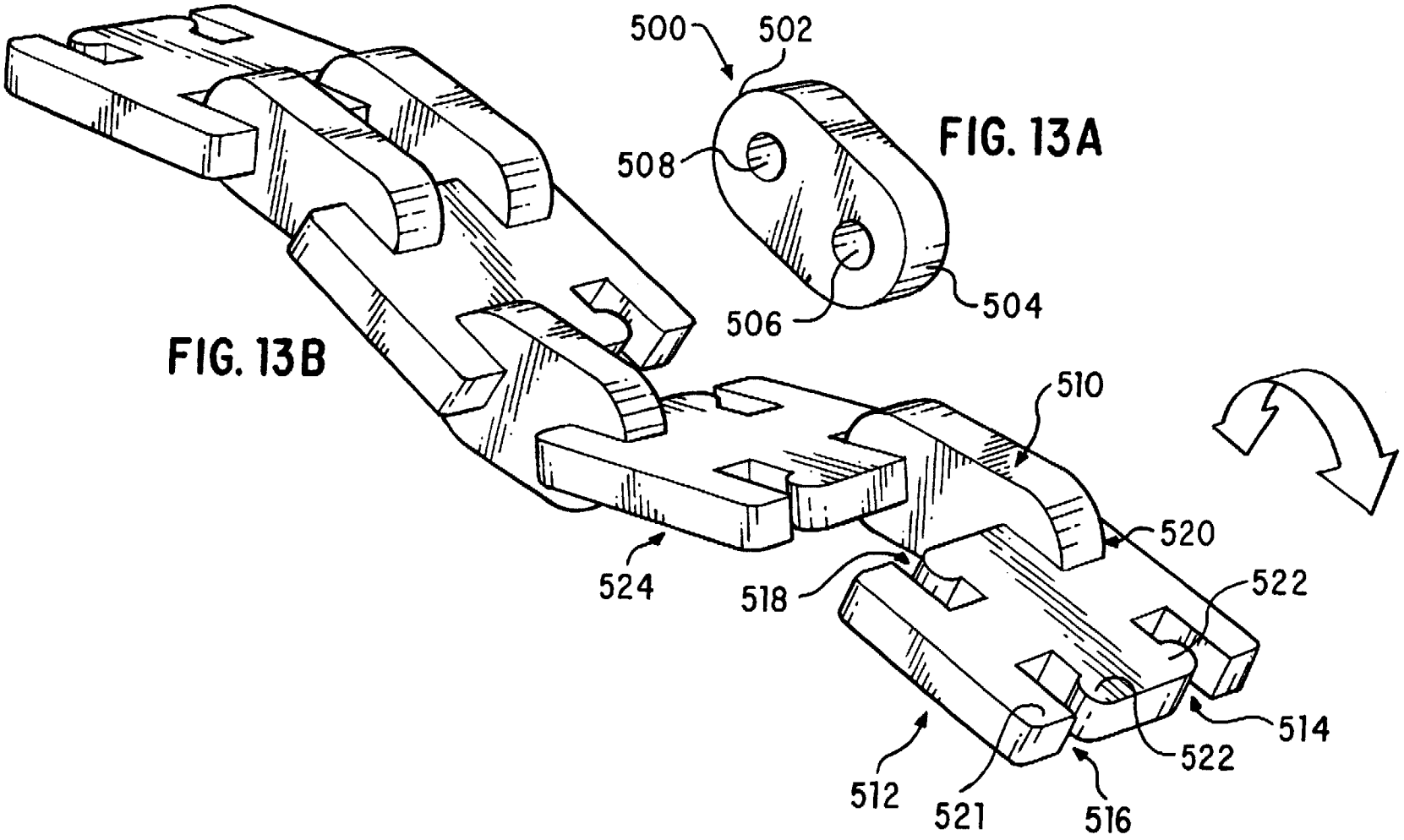
FIG. 13A is a perspective view of a connector according to the present invention.
FIG. 13B illustrates the connector of FIG. 13A used to interconnect puzzle pieces.

Connectors may be utilized to connect pieces of the present invention. Embodiments of some connectors according to the present invention are illustrated in FIGS. 13A, 13B and 14A–14C. A first preferred embodiment of a connector 500 is shown in FIG. 13A. Connector 500 is elongated and has curved ends 502 and 504. At least two substantially cylindrical channels 506, 508 are provided in spaced-apart manner along the length of the connector 500.

As shown in FIG. 13B, connector 500 is effective is providing a pivotable connection between two or more pieces. For example, piece 512 has four U-shaped mortise joints 514, 516, 518 and 520, each having an enlarged end 522 provided at the opening of the joint and extending inwardly towards the opening. The leg 521 of each joint is flexed to widen the opening of the mortise to pass each enlarged end 522 over the body of connector 500 and to fit enlarged end 522 inside a channel 506 or 508 of a connector 500 to provide a pivotable connection. The connector 500 is fitted inside the opening of the joint. Thus, FIG. 13B illustrates a connector 510 having one channel pivotally connected to piece 512 and a second channel pivotally connected to another piece 524. A plurality of these connectors 510 can be used to connect one or more pieces. Pivotable connections such as those illustrated in FIG. 13B are especially useful in building objects that have moving parts. Although the piece 512 is illustrated in FIG. 13B as having a particular configuration, it is also possible for the connector 500 to be used to pivotally connect any of the other pieces described in the prevent invention. The dimension of the channels 506, 508 are preferably sized to allow enlarged ends of pieces to be pivotally fitted therein.

A second preferred embodiment of a connector 550 is shown in FIG. 14C. The connector 550 may be used to connect two puzzle pieces 552 and 554, such as those illustrated in FIGS. 14A–14B. The first piece 552 has a tongue 556 provided at one end thereof, with an aperture 558 provided in tongue 556. The second piece 554 has an elongated or substantially rectangular aperture 560 having two long edges 562, 564 connected by two short edges 566, 568. The elongated aperture 560 is dimensioned and configured to receive tongue 556, so that long edges 562, 564 are preferably slightly longer than the width W3 of tongue 556, and short edges 566, 568 are preferably wider than the thickness T3 of tongue 556.

Connector 550 is substantially T-shaped with a top bar 570 and a stem 572. In use, the tongue 556 of first piece 552 is inserted through aperture 560 in the direction shown by arrow 574 so that aperture 558 extends beyond the body of piece 554. Stem 572 of connector 550 is then inserted through aperture 558 to lock or secure the two pieces 552 and 554 together. Thus, aperture 558 is preferably configured and dimensioned such that it will snugly receive stem 572 so that the stem 572 will not come loose and fall off, thereby compromising the integrity of the connection.

To disengage any of the connections described above, the user merely reverses the steps used to achieve the connection.

The puzzle pieces and connectors are preferably made from a soft material that is safe for use by children. A preferred material is foam, although other materials such as, but not limited to, plastic, wood, or paperboard, can be used without departing from the spirit and scope of the present invention.

Figures 16A, 16B:
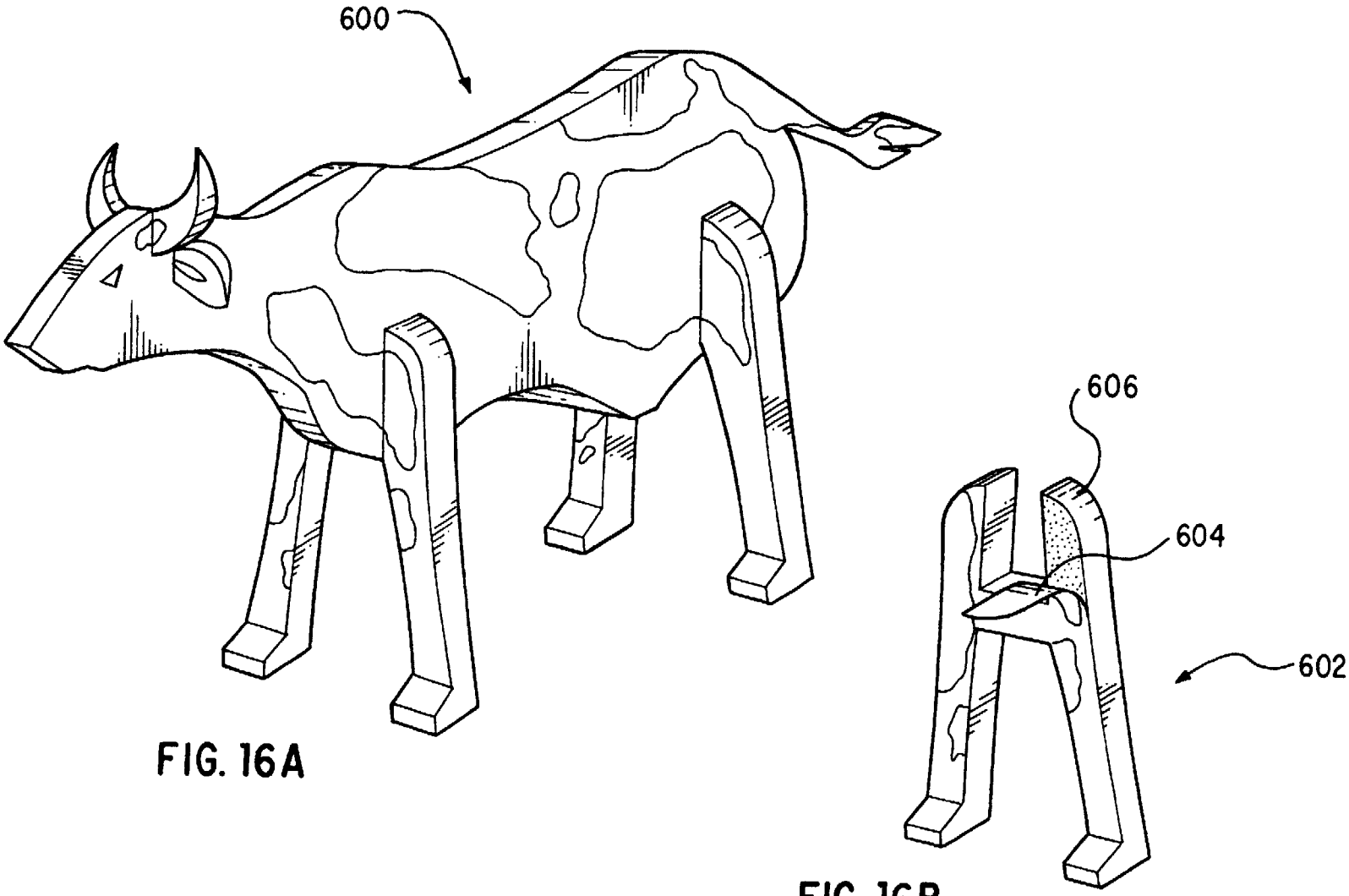
FIG. 16A is a perspective view of a three-dimensional model object, a cow, assembled with the interconnecting puzzle pieces according to the present invention.
FIG. 16B illustrates a rear leg piece of the cow of FIG. 16A with a lamination or design applied thereto.
Figure 16C:
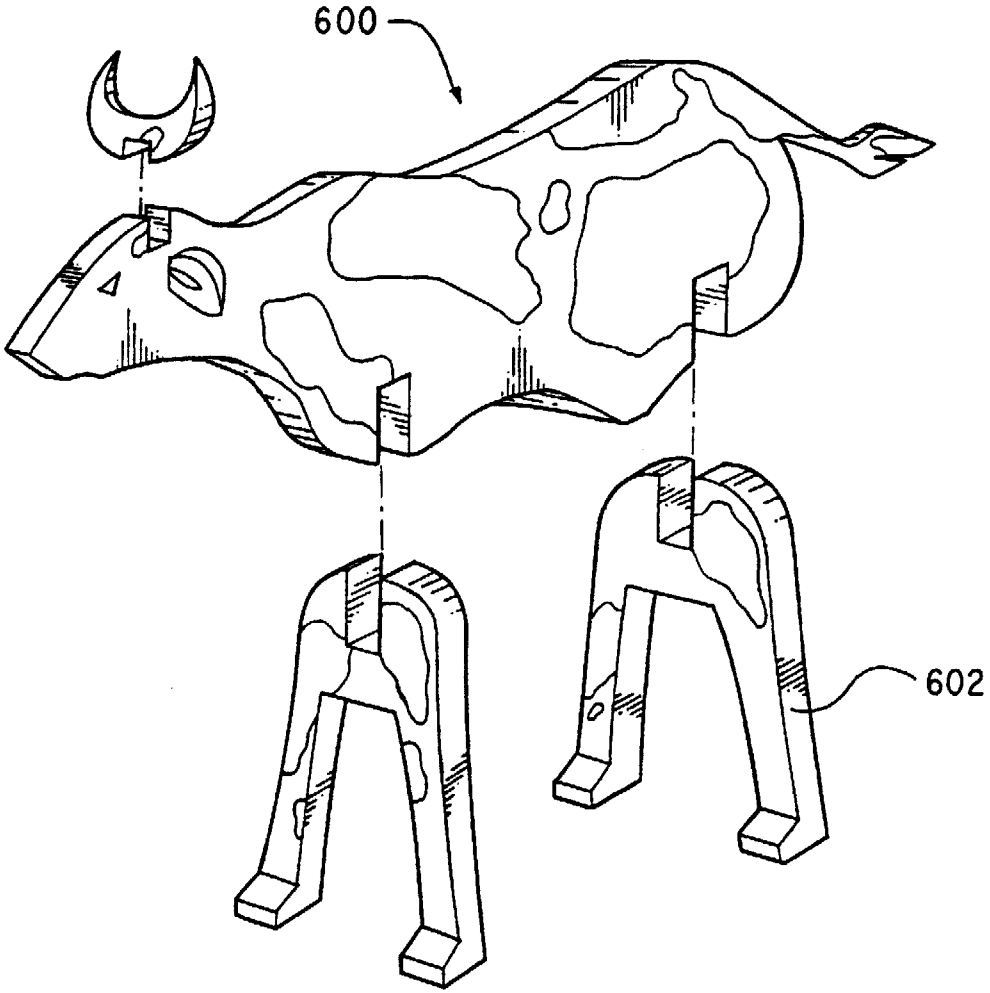
FIG. 16C is an exploded perspective view of the cow of FIG. 16A illustrating the various pieces thereof.

In addition, the surfaces and side edges of the puzzle pieces may be laminated with printed labels or may be directly printed with graphics, decals or other decorative images that match those of adjacent pieces when used to assemble a specific object. For example, FIG. 16A illustrates a cow 600 assembled from the puzzle pieces of the present invention. The pieces of the cow are provided with laminated designs that match those of adjacent pieces to provide the desired cow. The rear legs of the cow 600 are provided in one piece 602 (see FIG. 16B) which has a laminated design 604 adhered to the base piece 606. FIG. 16C is an exploded view of the various pieces that make up the cow 600, and how the laminated designs of each piece are matched to adjacent pieces.

While the description above refers to particular embodiments of the present invention, it will be understood that many modifications may be made without departing from the spirit thereof. The accompanying claims are intended to cover such modifications as would fall within the true scope and spirit of the present invention.

For example, although only portions of puzzle pieces have been illustrated, this is merely to illustrate the matching joints and apertures. It will be appreciated that the actual puzzle pieces will be complete pieces. These pieces can be provided in different configurations and dimensions, each having joints and/or apertures provided at different locations in each piece in the manner desired. The joints in each piece may have the same configuration, or each piece may be provided with different joints and apertures having different dimensions. The configurations of the pieces may in some cases be dictated by the locations and number of the joints and apertures. Also, the joints can be provided along corners of pieces to provide joints that open at different angles. Different pieces can have a different number of joints angled at different planes to provide for connection of multiple pieces at about the same location. Examples of the variety of pieces available are illustrated in the plane of FIG. 15 and the cow of FIG. 16A.

All joints and apertures according to the present invention are preferably provided in the same configuration and size so that they can be used universally to connect other joints and/or of other pieces. It is also possible to provide joints and apertures in a few different predetermined configurations and sizes so that certain joints and apertures will be adapted for use in connecting joints or apertures of the same size and configuration on other pieces.

The puzzle pieces and connectors according to the present invention can be used to assemble a large variety of two and three-dimensional objects, including objects with moving parts. Supporting protrusions (e.g., 56, 57) are provided in some embodiments to reinforce and strengthen the legs of joints. Connectors are provided to build pivotable connections. Other elements, including but not limited to protrusions (e.g. 60, 62), ridges (e.g., 106, 146), second apertures (e.g., 188, 284*a*), enlarged ends (e.g., 134, 176, 216, 236, 282*a*, 462, 464, 470, 472, 488, 522), and grooves (e.g., 218, 228), assist in providing a more secure interconnection between pieces. It will be appreciated that although only these elements have been illustrated, other such elements performing similar functions can be provided without departing from the spirit and scope of the present invention. These connections are easy to achieve, and are secure.

What is claimed is:

1. An object assembled by interconnecting a plurality of pieces, the object comprising:

a first piece comprising an outer side edge, a stem extending transversely from the outer side edge, and a leg connected to the stem and extending parallel to the outer side edge, the leg and the outer side edge defining a gap therebetween; and a second piece comprising a body and an aperture;

wherein the stem may be rotated within the aperture, and the body of the second piece is received inside the gap, when the stem and the leg of the first piece are connected to the aperture of the second piece.

2. The object of claim 1, wherein the aperture has first and second long edges, and first and second short edges connected by the first and second long edges, wherein the stem has an inner edge, and wherein the inner edge of the stem of the first piece is adjacent the second short edge of the aperture of the second piece, and the body of the second piece is received inside the gap, when the stem and the leg of the first piece is connected to the aperture of the second piece.

3. The object of claim 2, wherein the stem may be rotated within the aperture so that the inner edge of the stem of the first piece is adjacent one of the long edges of the aperture of the second piece.

4. The object of claim 1, wherein the first piece further comprises an aperture, the aperture having first and second long edges, and first and second short edges connected by the first and second long edges.

5. The object of claim 1, wherein the first piece has a body having a thickness, and wherein the stem and the leg have the same thickness as the thickness of the body of the first piece.

6. The object of claim 5, wherein the first and second pieces are disposed tranverse to each other at the connection between the first and second pieces at the aperture.

7. An object assembled by interconnecting a plurality of pieces, the object comprising:

a first piece comprising an outer side edge, a stem extending transversely from the outer side edge and having an inner edge, and a leg connected to the stem and extending parallel to the outer side edge, the leg and the outer side edge defining a gap therebetween; and a second piece comprising a body and an enclosed aperture, the aperture having first and second longitudinal edges, and first and second transverse edges connected by the first and second longitudinal edges;

wherein the inner edge of the stem of the first piece is adjacent one of the edges of the aperture of the second piece, and the body of the second piece is received inside the gap, when the stem and the leg of the first piece is connected to the aperture of the second piece, with the first and second pieces disposed tranverse to each other at the aperture.

8. The object of claim 7, wherein the first piece has a body having a thickness, and wherein the stem and the leg have the same thickness as the thickness of the body of the first piece.

9. The object of claim 7, wherein the stem may be rotated within the first aperture, and the body of the second piece is received inside the gap, when the stem and the leg of the first piece are connected to the first aperture of the second piece.

10. The object of claim 9, wherein the stem may be rotated within the first aperture so that the inner edge of the stem of the first piece is adjacent one of the transverse edges of the first aperture of the second piece.

11. The object of claim 7, wherein the first piece further comprises an aperture, the aperture having first and second long edges, and first and second short edges connected by the first and second long edges.

12. A method of assembling an object, comprising the steps of:

providing a first piece comprising an outer side edge, a stem extending transversely from the outer side edge, and a leg connected to the stem and extending parallel to the outer side edge, the leg and the outer side edge defining a gap therebetween;

providing a second piece comprising a body and an aperture;

inserting the leg of the first piece through the aperture of the second piece;

positioning the body of the second piece inside the gap; and rotating the stem within the aperture.

13. A method of assembling an object, comprising the steps of:

providing a first piece comprising an outer side edge, a stem extending transversely from the outer side edge, and a leg connected to the stem and extending parallel to the outer side edge, the leg and the outer side edge defining a gap therebetween;

providing a second piece comprising a body and an enclosed aperture, the aperture having first and second longitudinal edges, and first and second transverse edges connected by the first and second longitudinal edges;

inserting the leg of the first piece through the aperture of the second piece; and positioning the body of the second piece inside the gap so that the first and second pieces are transverse to each other at the aperture.

14. The method of claim 13, further including the step of providing the stem and the leg with the same thickness as the thickness of the body of the first piece.

* * * * *